US009914041B2

(12) United States Patent
Vorozilchak

(10) Patent No.: US 9,914,041 B2
(45) Date of Patent: Mar. 13, 2018

(54) HOCKEY PRACTICE DEVICE

(71) Applicant: David Vorozilchak, Shavertown, PA (US)

(72) Inventor: David Vorozilchak, Shavertown, PA (US)

( * ) Notice: Subject to any disclaimer, the term of this patent is extended or adjusted under 35 U.S.C. 154(b) by 0 days.

(21) Appl. No.: 15/177,738

(22) Filed: Jun. 9, 2016

(65) Prior Publication Data

US 2016/0361620 A1 Dec. 15, 2016

Related U.S. Application Data

(60) Provisional application No. 62/172,992, filed on Jun. 9, 2015.

(51) Int. Cl.
*A63B 69/40* (2006.01)
*A63B 69/00* (2006.01)

(52) U.S. Cl.
CPC ..... *A63B 69/406* (2013.01); *A63B 69/0026* (2013.01)

(58) Field of Classification Search
CPC ..... A63B 69/406; A63B 69/0026; A63B 2069/402; A63B 2102/22; A63B 2102/24
See application file for complete search history.

(56) References Cited

U.S. PATENT DOCUMENTS 3,794,318 A * 2/1974 Holmes ..... A63B 63/06 124/1
3,817,235 A 6/1974 Laurence
4,002,336 A * 1/1977 Beaver ..... A63B 69/409 124/56
4,015,578 A 4/1977 Wright
(Continued)

FOREIGN PATENT DOCUMENTS

| | | |
|---|---|---|
| CA | 2141904 | 8/1996 |
| CA | 2790533 | 3/2014 |
| FR | 2587473 | 3/1987 |

OTHER PUBLICATIONS

Puck Chucker (Marleau) Jan. 1, 2014 retrieved from URL: https://www.youtube.com/watch?v=1BB684by4o0> entire video, especially demonstration 0:00-1:50.

(Continued)

*Primary Examiner* — Melba Bumgarner
*Assistant Examiner* — Amir Klayman
(74) *Attorney, Agent, or Firm* — The Belles Group, P.C.

(57) ABSTRACT

A hockey practice device in one embodiment includes a base for resting on a horizontal surface, a motor, a rotating firing wheel coupled to the motor, and a puck feed ramp mounted proximate to the firing wheel on the base. The feed ramp includes an arcuately curved and elongated feed surface arranged to slideably engage a puck. In one arrangement, the firing wheel is rotatable in a vertical rotational plane which is arranged in an off-axis manner from the centerline of the ramp feed surface. This engages the puck off center, thereby inducing spin to the puck when it is discharged from the device toward a target which replicates a pass from a hockey stick. A puck loader is provided that holds a plurality of puck which are automatically dispensed in sequential fashion at pre-selected time intervals to the feed ramp.

11 Claims, 30 Drawing Sheets

(56) References Cited

U.S. PATENT DOCUMENTS

| | | | | |
|---|---|---|---|---|
| 4,025,071 | A * | 5/1977 | Hodges | A63B 69/406 124/51.1 |
| 4,191,374 | A | 3/1980 | Kulesza et al. | |
| 4,823,763 | A * | 4/1989 | Ponza | A63B 69/406 124/1 |
| 4,875,459 | A * | 10/1989 | Van Elderen | A63F 9/02 124/1 |
| 5,255,917 | A | 10/1993 | Morrow et al. | |
| 5,396,876 | A | 3/1995 | Liscio et al. | |
| 5,707,304 | A | 1/1998 | Bellelsle | |
| 7,000,922 | B1 | 2/2006 | Norton | |
| 7,166,045 | B1 | 1/2007 | Linner et al. | |
| 7,207,893 | B1 * | 4/2007 | Louie | A63B 63/00 473/166 |
| 8,707,942 | B2 | 4/2014 | Lu | |
| 8,833,355 | B2 | 9/2014 | Paulson | |
| 2002/0082125 | A1 * | 6/2002 | Markin | A63B 69/406 473/451 |
| 2002/0134367 | A1 | 9/2002 | Delso | |
| 2003/0192522 | A1 * | 10/2003 | Taryoto | A63B 67/18 124/78 |
| 2005/0016516 | A1 * | 1/2005 | Richard | A63B 69/406 124/78 |
| 2005/0172943 | A1 * | 8/2005 | Cucjen | A63B 69/406 124/6 |
| 2009/0095273 | A1 * | 4/2009 | Paulson | A63B 69/0002 124/78 |
| 2016/0262351 | A1 * | 9/2016 | Hamill | A01K 15/025 |

OTHER PUBLICATIONS

Corresponding International Search Report and Written Opinion for PCT/US16/36633 dated Nov. 2, 2016.

Omega Wheels, http://www.rwmcasters.com/caster_wheels/omega_wheels.cfm, Searched for on Jun. 5, 2016.

* cited by examiner

HOCKEY PRACTICE DEVICE

CROSS-REFERENCE TO RELATED APPLICATIONS

The present application claims the benefit of priority to U.S. Provisional Application No. 62/172,992 filed Jun. 9, 2015, which is incorporated herein by reference in its entirety.

BACKGROUND

The present invention generally relates to training or practice devices for ice hockey, and more particularly to a practice device for discharging or passing a disk-shaped object such as a hockey puck towards a target.

In the sport of ice hockey, it is desirable to provide a practice device which can be used to simulate a shot or passed puck under conditions which closely approximates the speed and trajectory of the puck experienced during actual game play. It is further desirable to provide a device which is suitable for both professional and personal use, compact and highly portable, mechanically simple with inherently better reliability, and easy to operate. Some prior attempts in the field have produced various contraptions which are mechanically complex devices that are cumbersome to store and transport, and not readily adapted for both professional and personal use. In addition, some are limited by the amount of force generated to launch the puck, thereby limiting the maximum delivery speed of the puck.

A need exists for an improved and versatile hockey practice device capable of launching a hockey puck.

SUMMARY

Embodiments according to the present disclosure provide a compact and readily portable hockey practice device which is carryable by a single user. The device is configured and operable to automatically launch a plurality of pucks in a sequentially timed manner towards a target such the user or player for training purposes. The device may be operated by a single user during a practice session. The device may further be configured in certain embodiments to control the speed of the puck and interval of time between puck launches or delivery as pre-selected by the user. A partially disassemblable and detachable puck loader mounts on the device which facilitated transport of the device. The loader is configured and operable to hold and dispense a plurality of pucks via gravity, which in one non-limiting embodiment are held in a vertical rolling position on the puck loader tracks.

The practice device generally comprises a motor-operated rotating firing wheel (e.g. puck feed wheel) and an arcuately curved puck feed ramp which cooperates with the ramp to launch puck. The wheel is disposed over and spaced slightly apart from the feed ramp by a distance less than the thickness of the puck. The peripheral portion of the firing wheel may be formed of a relatively hard urethane or similar material and is structured to be partially deformable for engaging the puck between the wheel and ramp. The firing wheel may be constructed to have high-friction characteristics for creating a positive grip on the puck as it is engaged and accelerated by the wheel. By contrast, the feed ramp preferably may be constructed to have lower friction characteristics in comparison to the firing wheel to both assist in accelerating and maintaining the speed of the puck ejected by the wheel from the practice device.

According to one aspect, a hockey practice device for launching hockey pucks includes a planar base for resting on a horizontal surface, a motor supported by the base, a compressible firing wheel coupled to the motor and rotatable in a vertical rotational plane via operation of the motor, and a feed ramp mounted proximate to the firing wheel and including an arcuately curved feed surface arranged to slideably engage a puck. The vertical rotational plane of the firing wheel is arranged laterally off-axis from a centerline of the feed surface of the feed ramp to engage the puck off center and induce spin to the puck.

In another aspect, a hockey practice device for launching hockey pucks towards a target includes: a base; a motor coupled to the base; a compressible firing wheel coupled to the motor and rotatable in a vertical rotational plane via operation of the motor; a feed ramp mounted proximate to the firing wheel that slideably engages a puck, the feed ramp includes a top end defining an upper puck receiving portion, a bottom end defining a lower puck discharge portion for launching the puck at a target, an intermediate puck engagement portion disposed between the discharge and receiving portions, and an arcuately curved puck feed surface defined by the feed ramp that extends between the top and bottom ends; and a puck loader comprising a loading arm operable to hold and dispense a plurality of vertically upright pucks onto the feed ramp. In some embodiments, the vertical rotational plane of the firing wheel is arranged laterally off axis from a centerline of the feed ramp, the firing wheel operating to engage each puck in an off center manner that induces rotation of the puck when discharged from the feed ramp.

A method for storing and launching hockey pucks at a target is provided. The method includes steps of: storing a plurality of pucks in a puck loader; depositing one of the pucks in an upright position onto an arcuately curved feed ramp; sliding the puck downwards on the feed ramp; engaging the puck with a compressible rotating firing wheel; changing orientation of the puck from upright to horizontal; and discharging the puck from feed ramp towards the target.

BRIEF DESCRIPTION OF THE DRAWINGS

The features of the preferred embodiments will be described with reference to the following drawings where like elements are labeled similarly, and in which.

All drawings are schematic and not necessarily to scale. A reference herein to a figure number herein that may include multiple figures of the same number with different alphabetic suffixes shall be construed as a general reference to all those figures unless specifically noted otherwise.

DETAILED DESCRIPTION

Figure 1:
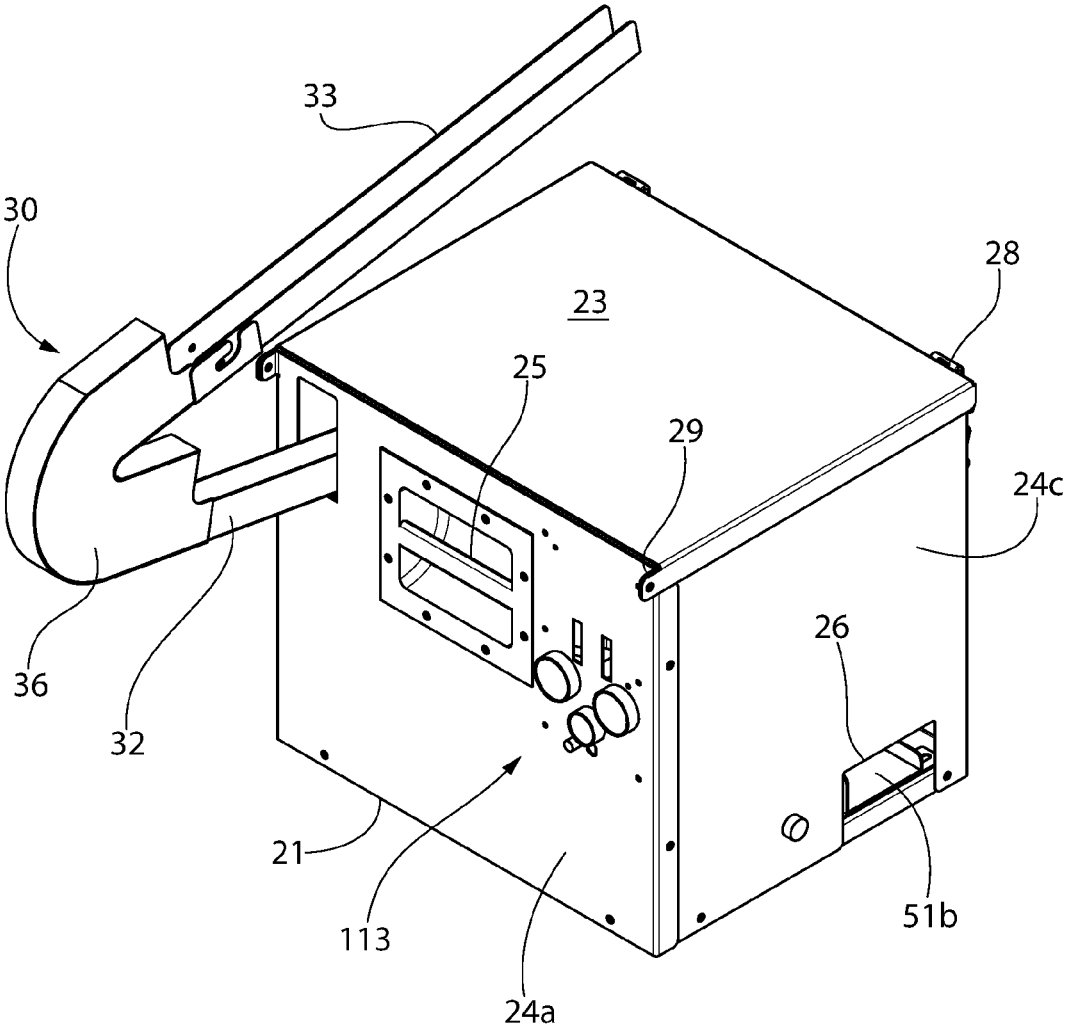
FIGS. 1 and 2 are front and rear perspective views of a practice device according to the present disclosure.
Figure 2:
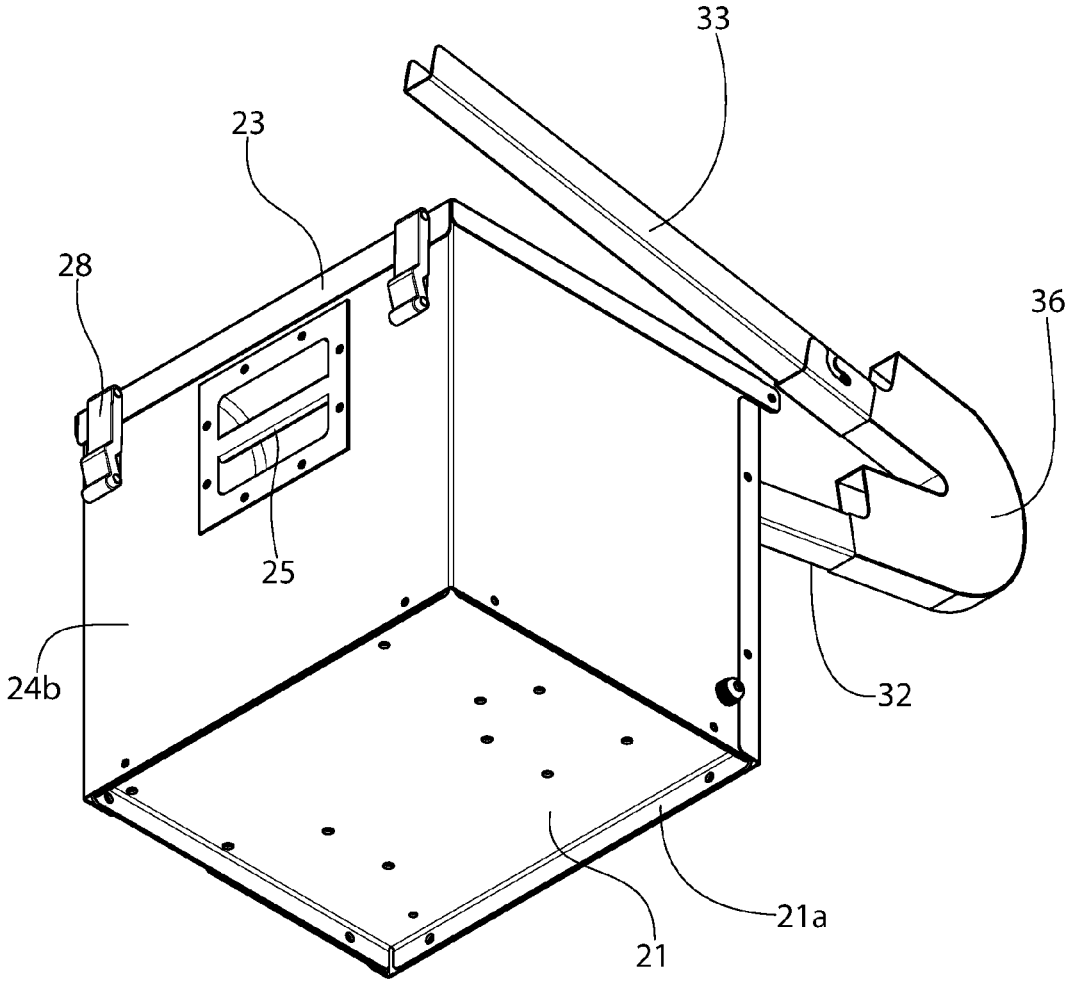
Figure 3:
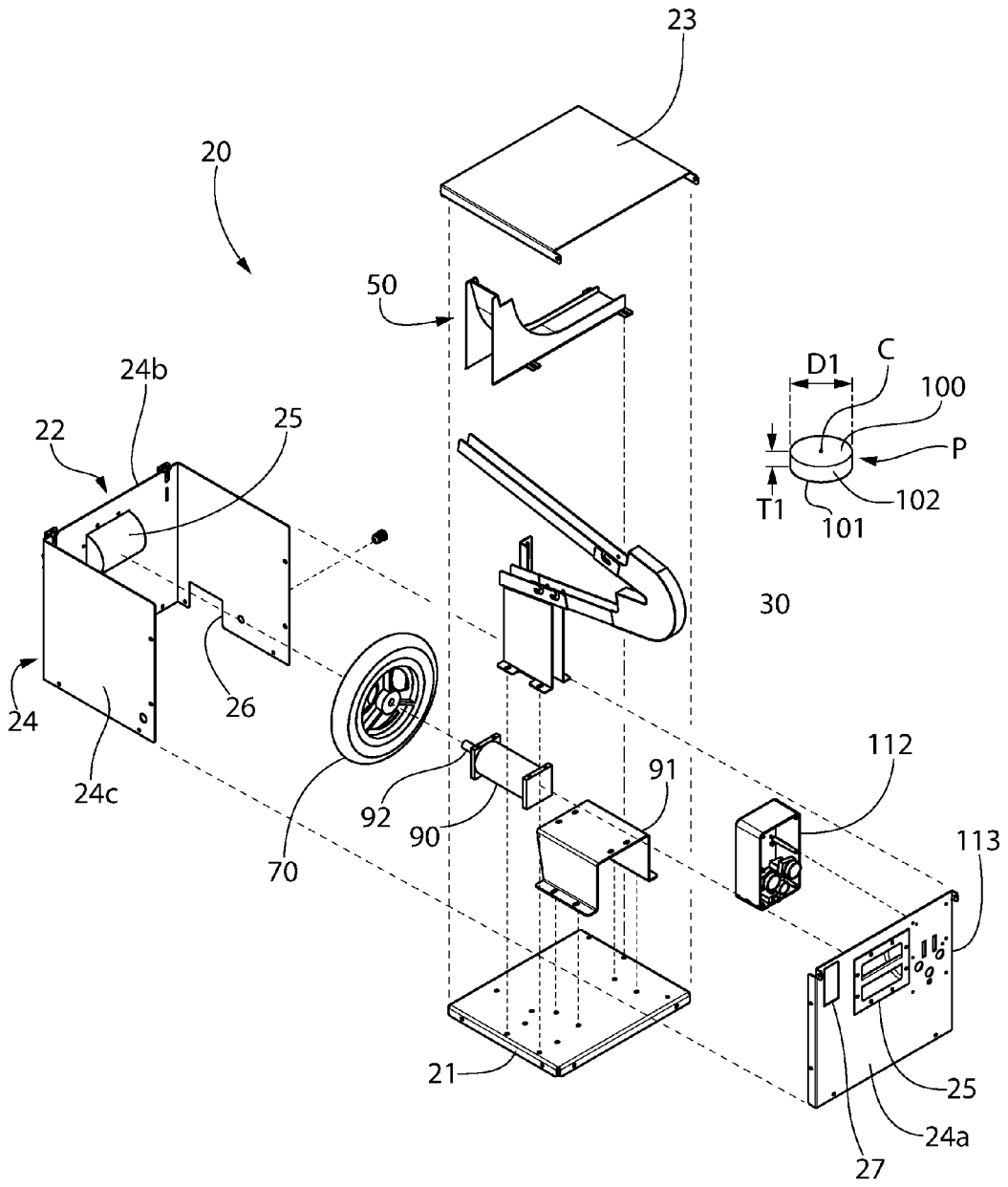
FIG. 3 is an exploded perspective view thereof.
Figure 4:
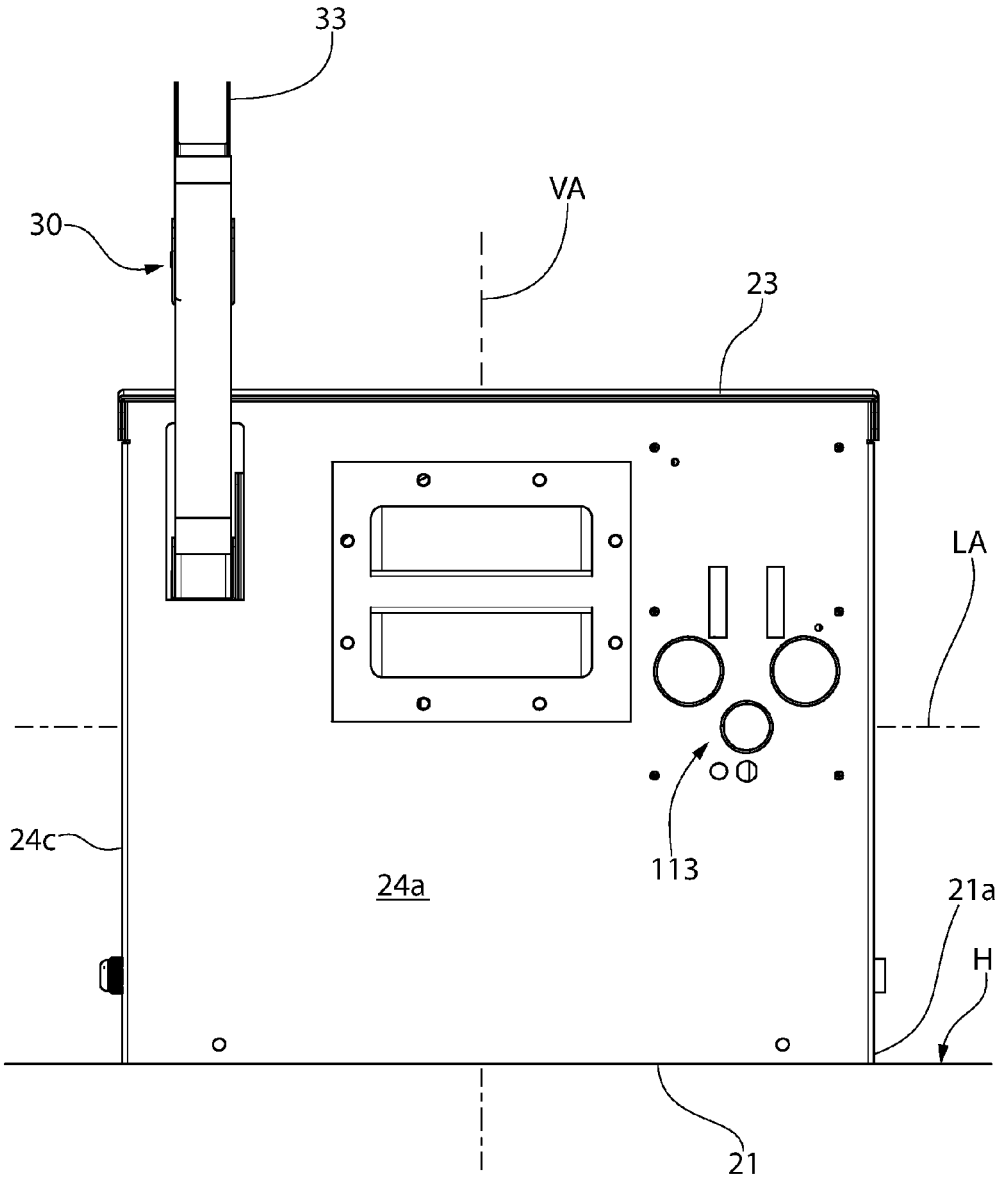
FIGS. 4 and 5 are left and right side elevation views thereof.
Figure 5:
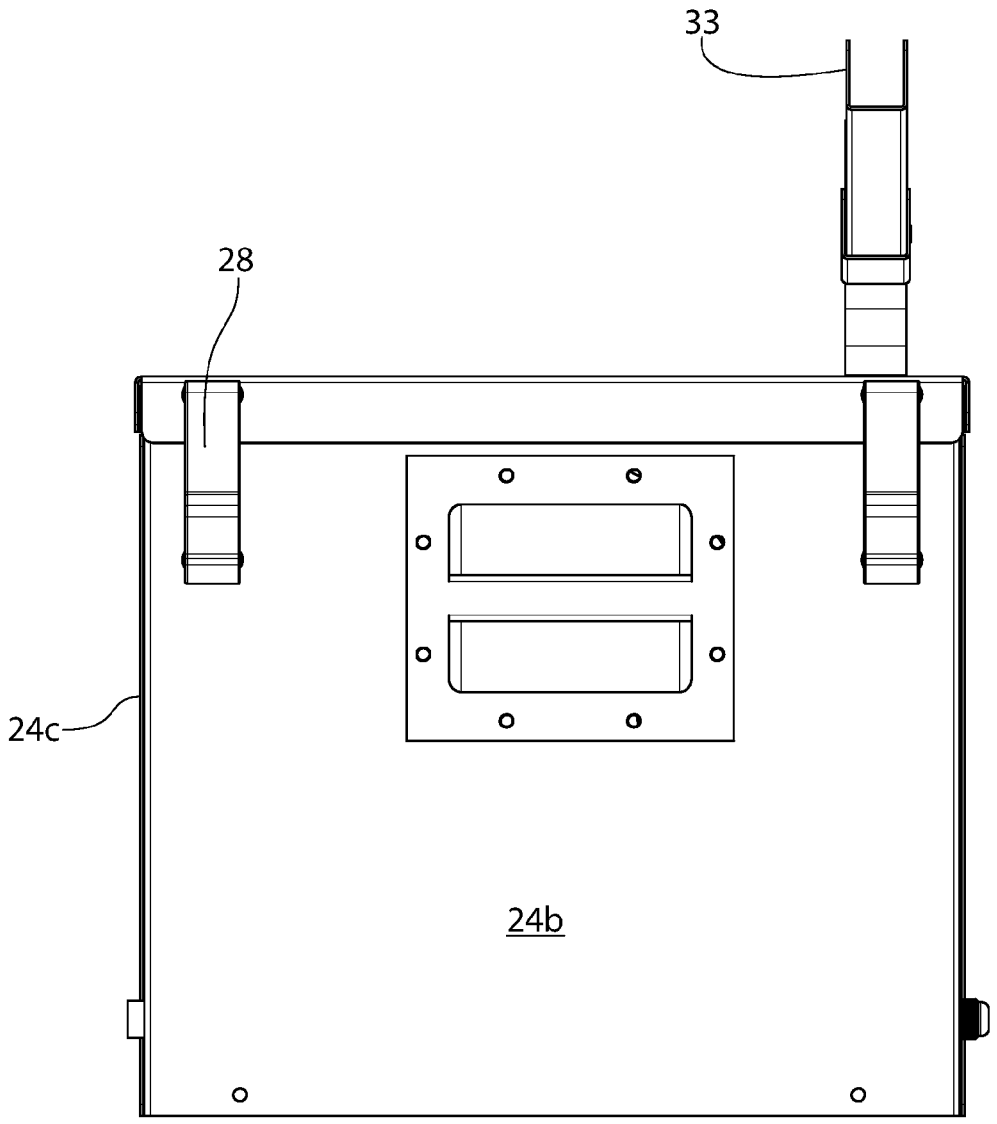
Figure 6:
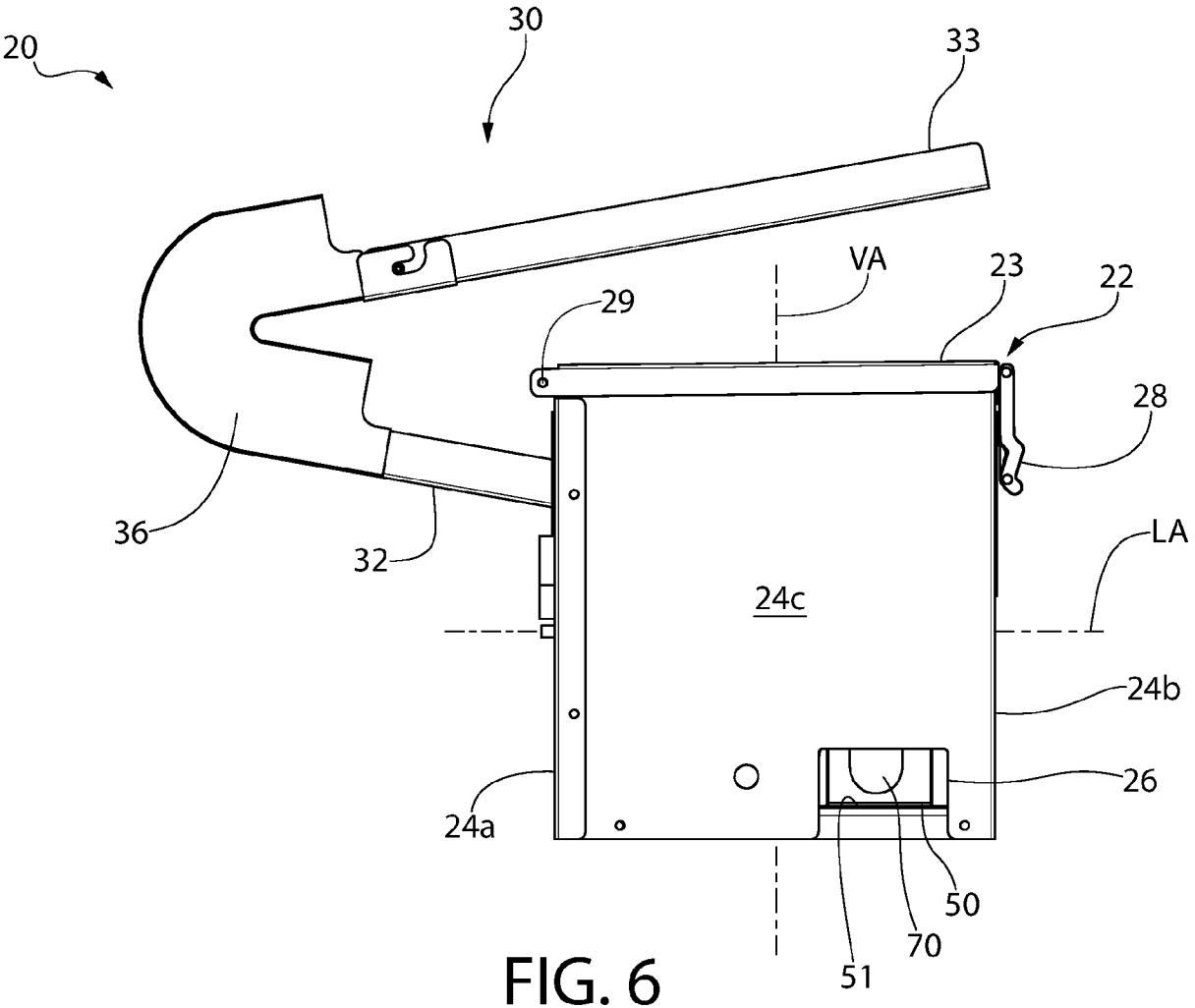
FIGS. 6 and 7 are front and rear elevation views thereof.
Figure 7:
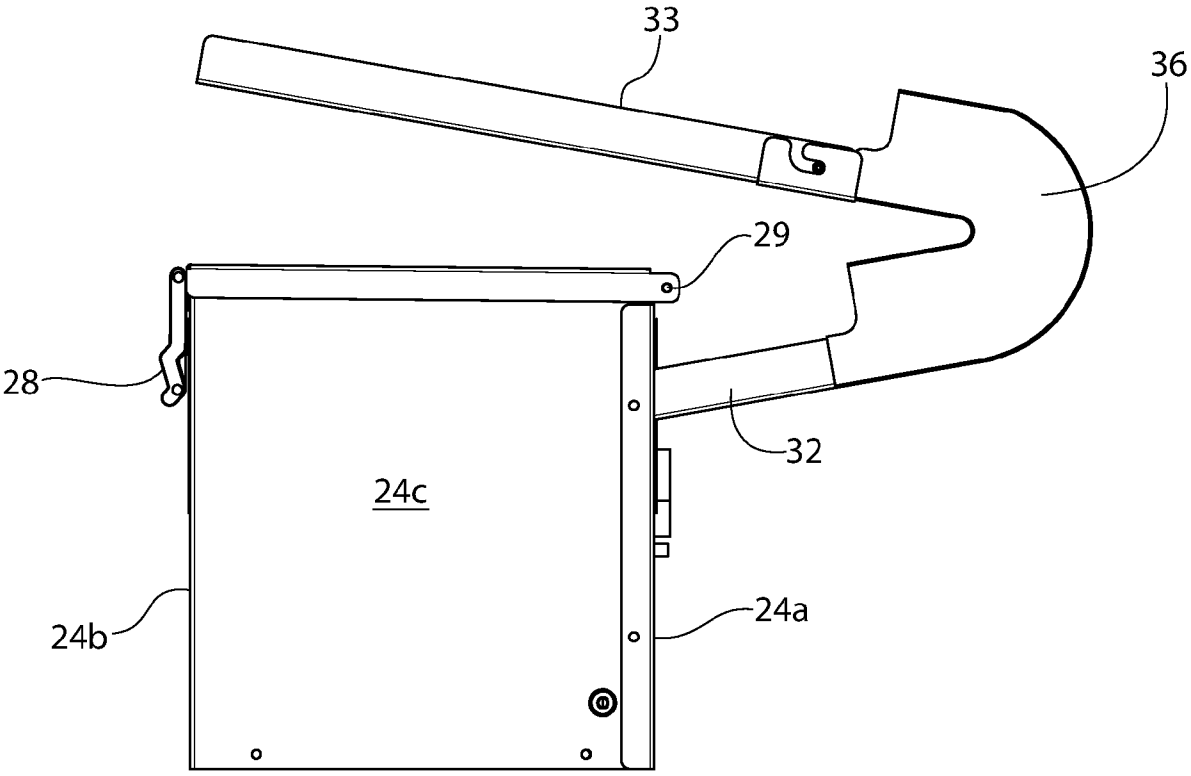
Figure 8:
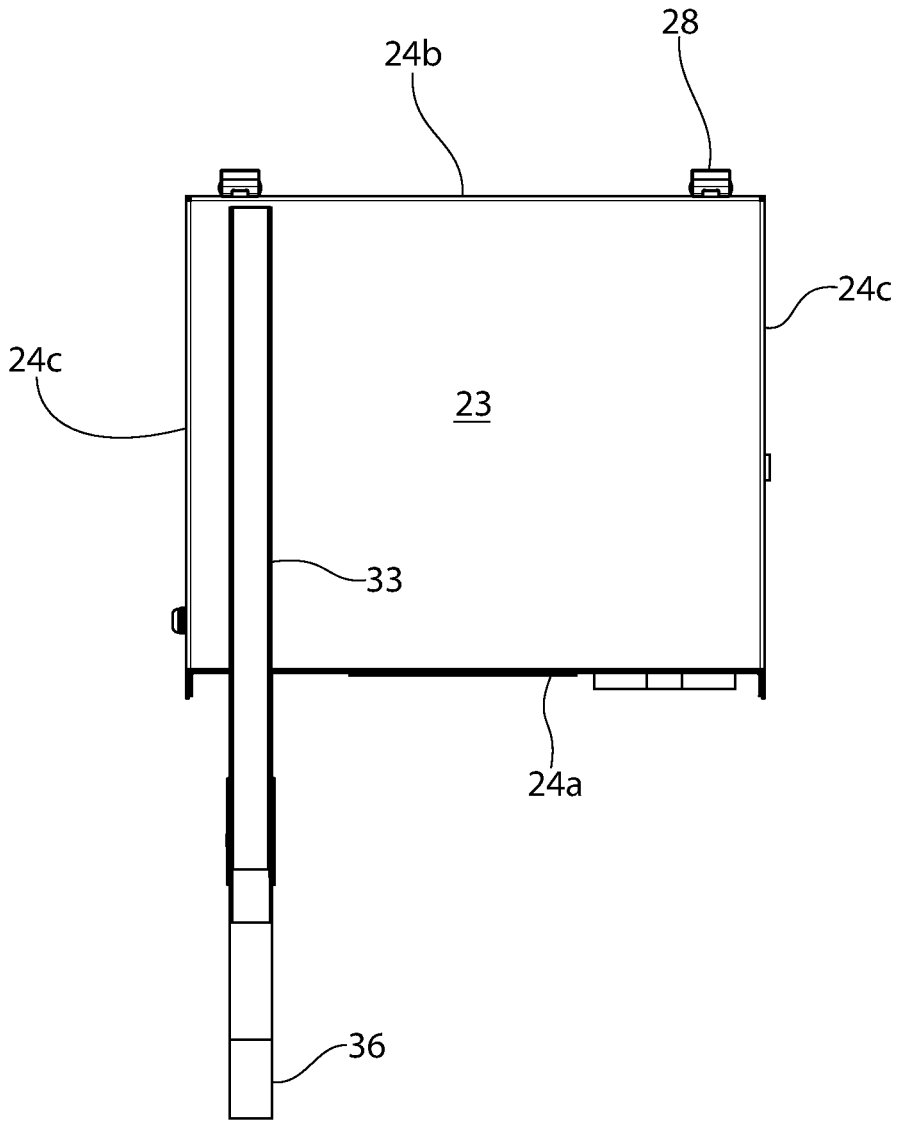
FIG. 8 is a top plan view thereof.
Figure 9:
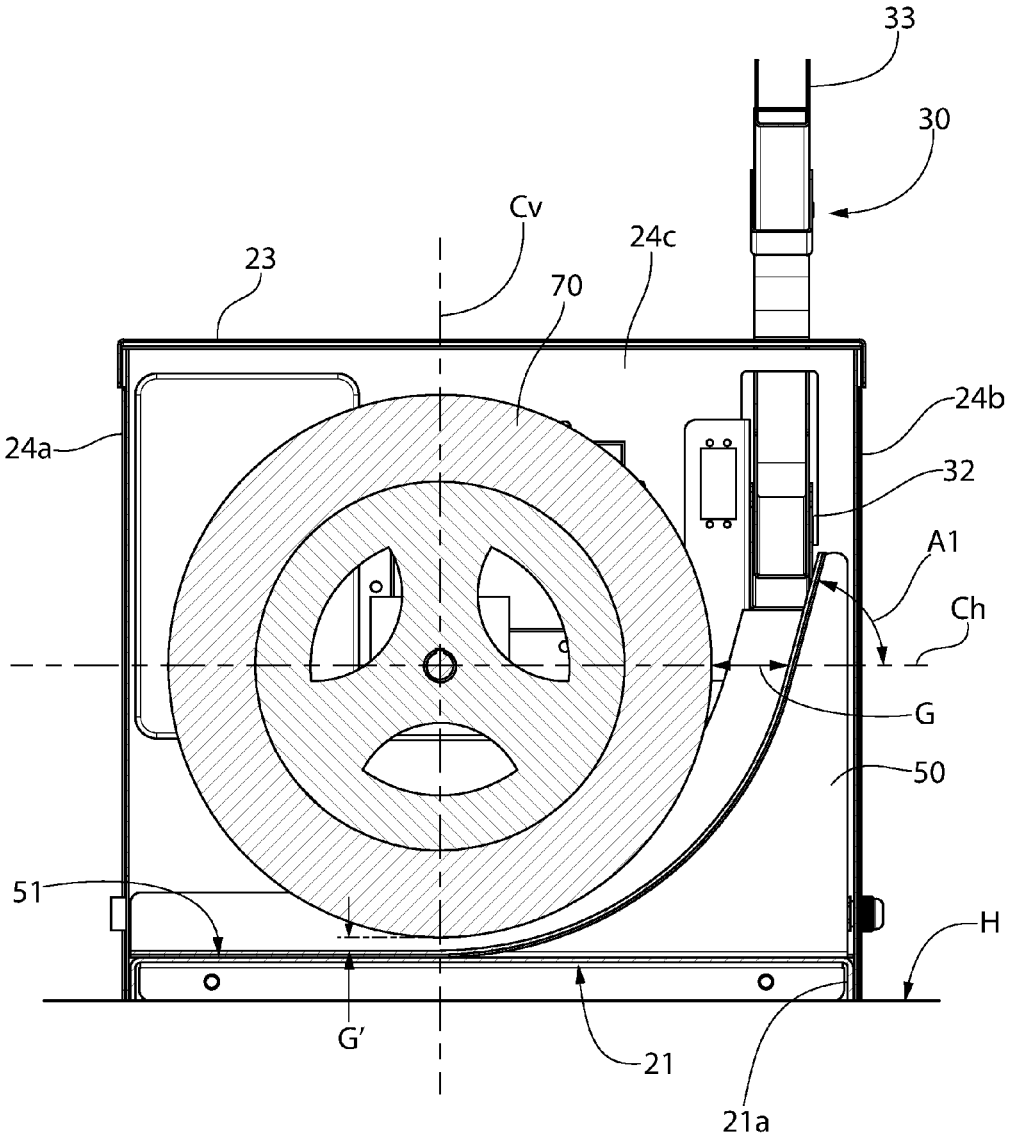
FIG. 9 is a side cross sectional view thereof.
Figure 10:
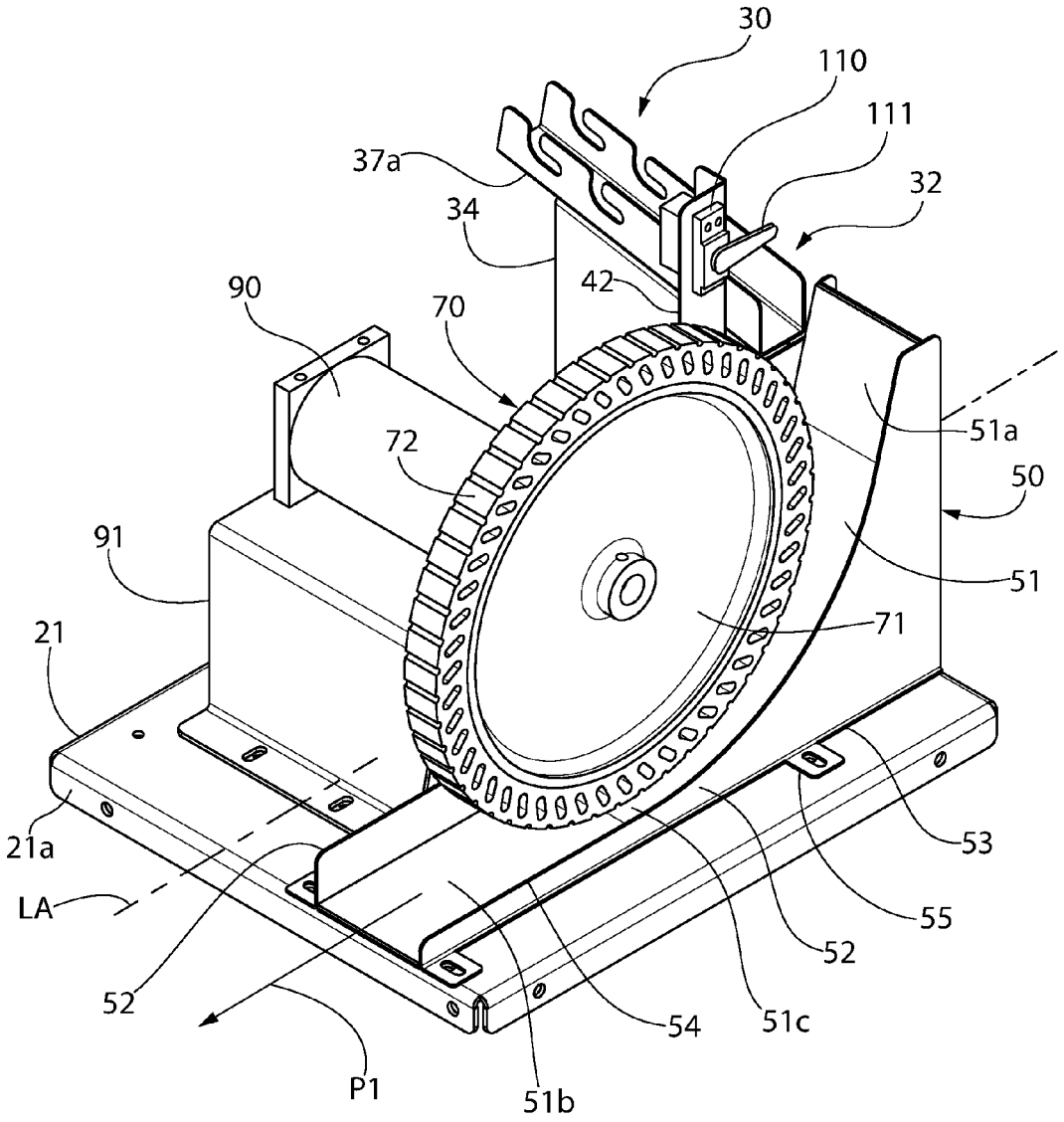
FIGS. 10 and 11 are right and left perspective views of the practice device with the enclosure removed.
Figure 11:
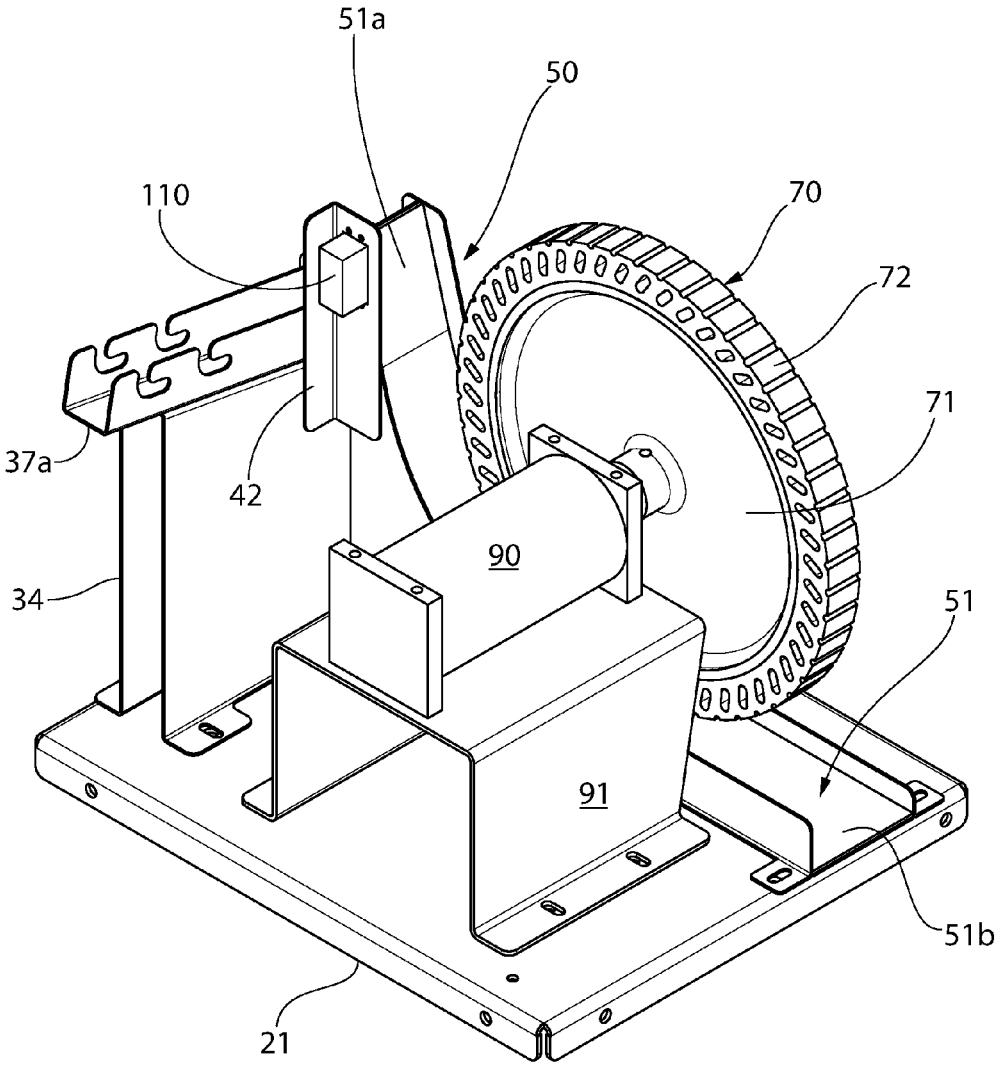
Figure 12:
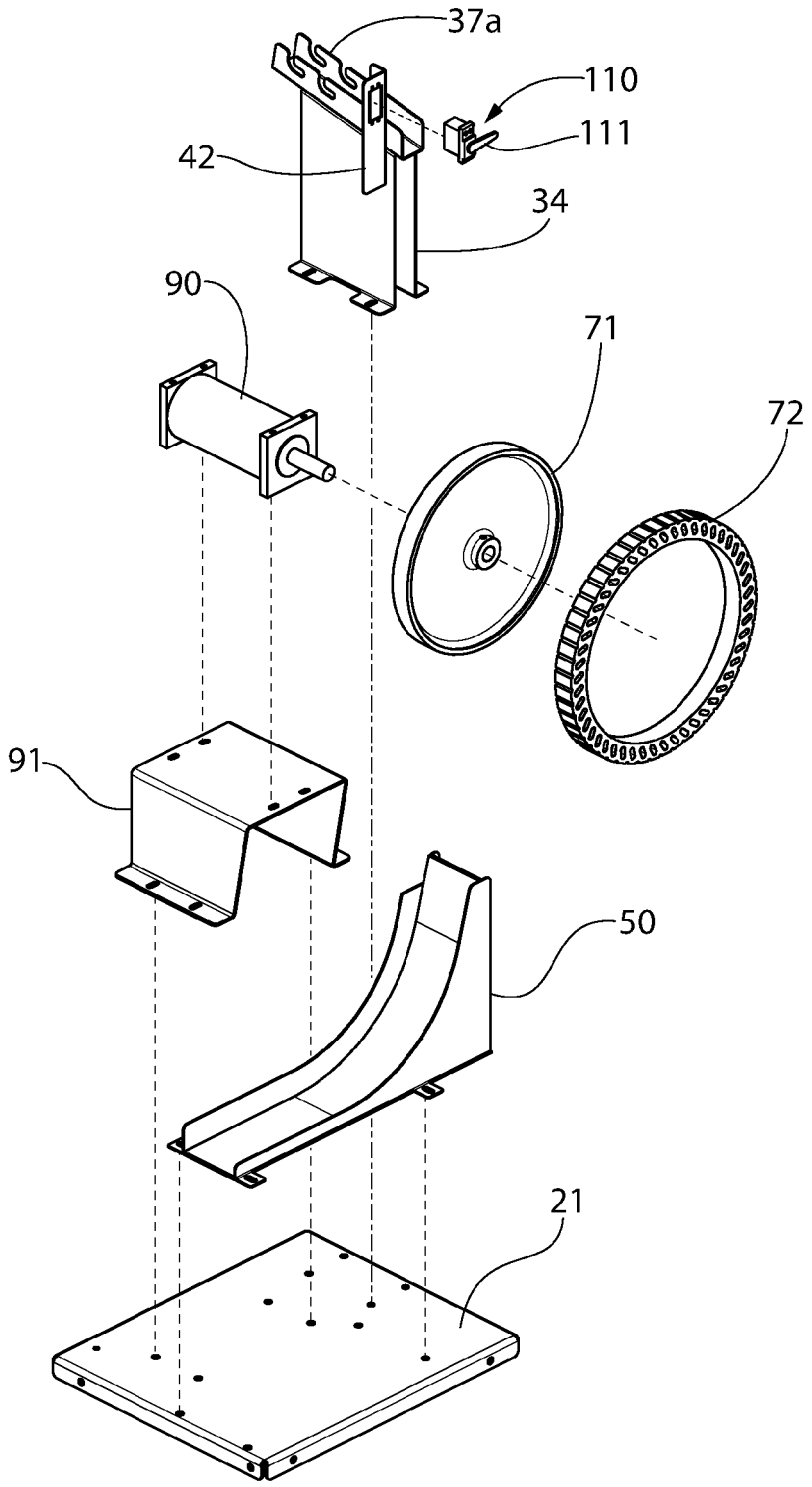
FIG. 12 is an exploded perspective view thereof.
Figure 13:
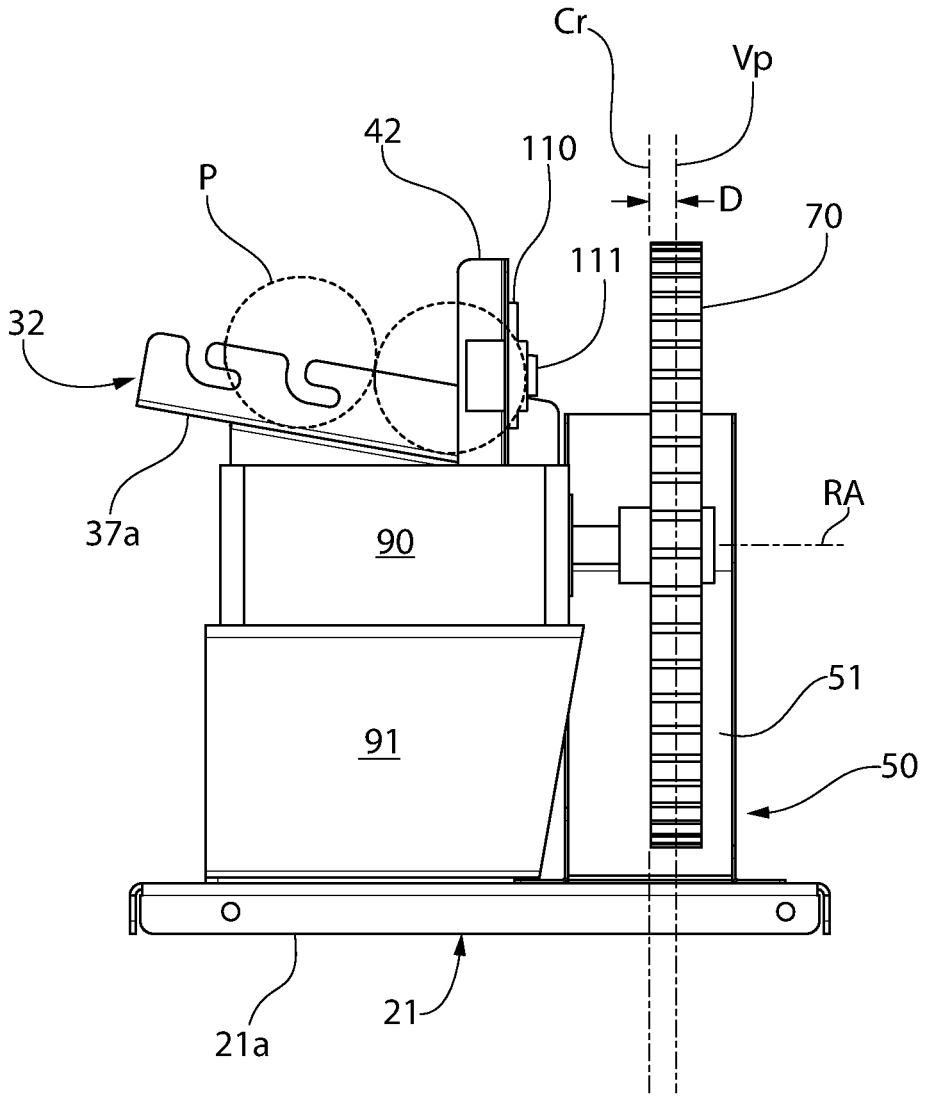
FIGS. 13 and 14 are front and rear elevation views thereof.
Figure 14:
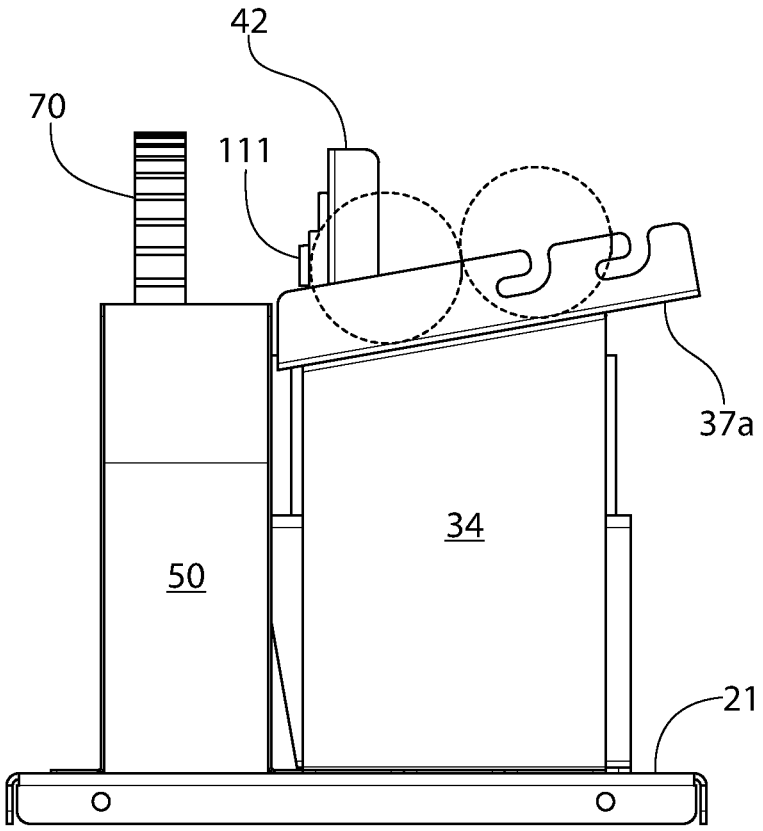
Figure 15:
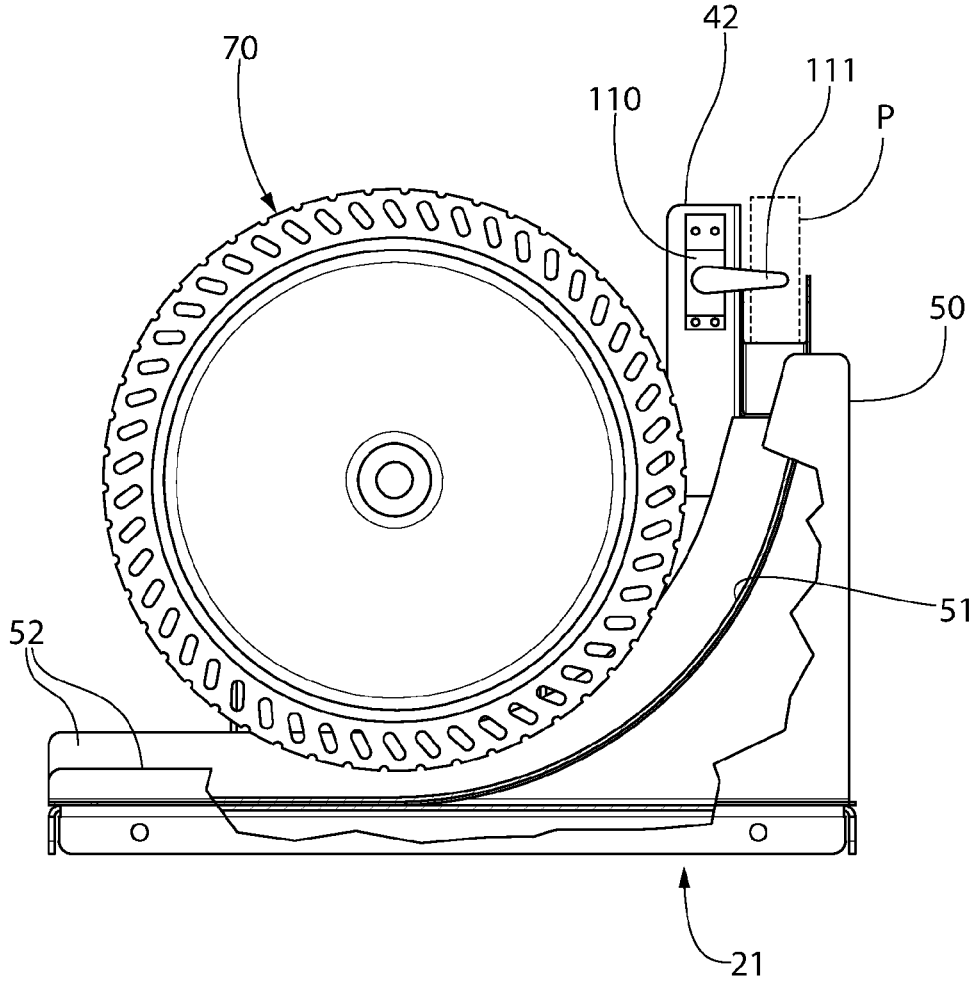
FIGS. 15 and 16 are right and left side elevation views thereof.
Figure 16:
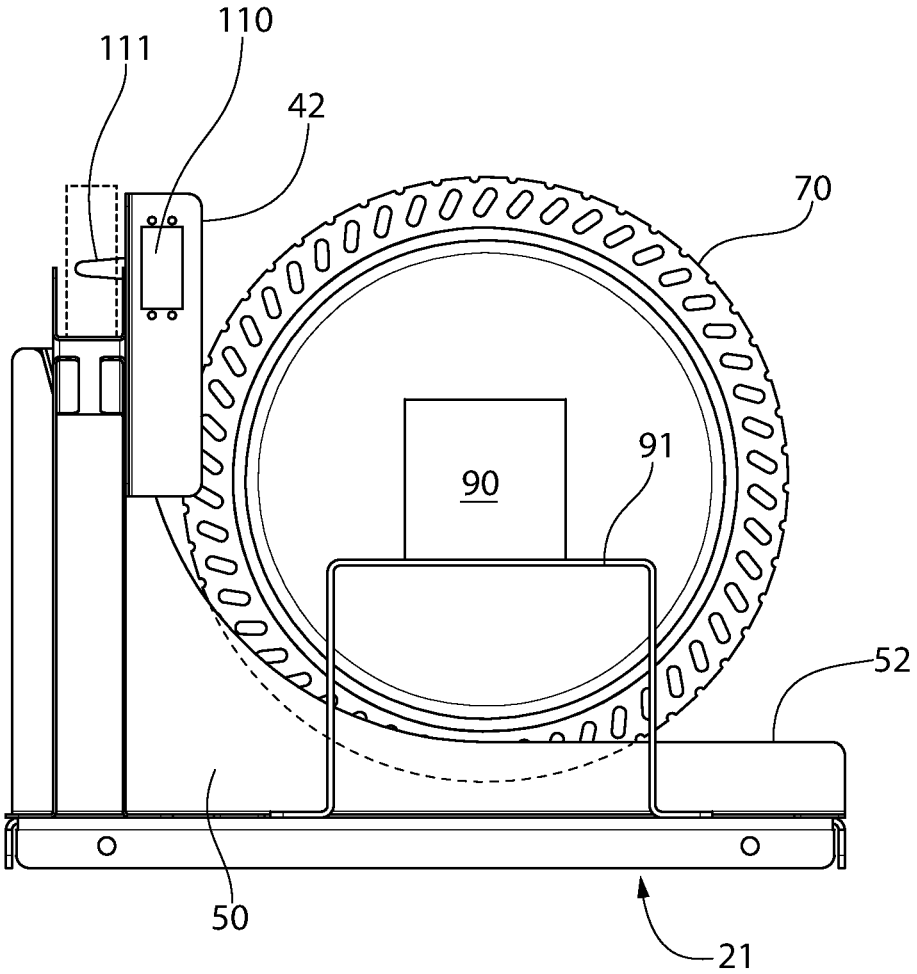

The features and benefits of the invention are illustrated and described herein by reference to exemplary embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

As used throughout, any ranges disclosed herein are used as shorthand for describing each and every value that is within the range. Any value within the range can be selected as the terminus of the range.

Referring to FIGS. 1-17, a practice device 20 is shown according to the present disclosure which is especially configured and operable to accelerate and fire or launch a disk-like object towards a target in a sliding manner across a preferably flat surface. In one non-limiting embodiment, the disk-like object may be an ice hockey puck. The flat surface may be any flat surface formed of without limitation ice and other natural (e.g. wood, stone, etc.) or man-made materials (e.g. concrete, macadam, polymers, etc.).

Practice device 20 generally includes a mounting base such as base plate 21 configured for resting on a horizontal practice surface H, a puck loader 30, a feed ramp 50, a rotatable launch or firing wheel 70, and a wheel motor 90 operable to rotate the firing wheel. Base plate 21 has an overall substantially planar construction, which may be formed of a suitably configured metal plate or sheet to provide a secure platform for mounting and supporting the foregoing components. In one embodiment, base plate 21 may be equipped with downwardly extending flanges 21*a* which arranged to engage a practice surface H for slightly elevating the base above the practice the surface.

Optionally, a box-like enclosure 22 may be provided to house and protect these components, as well as protect a user from inadvertently encountering the moving parts of the device such as the firing wheel which may rotate at substantially high RPMs (revolutions per minute).

Enclosure 22 generally includes an openable/closeable top lid 23 and plurality of sidewalls 24 extending downwards from the lid which attach to base plate 21 at the bottom. Enclosure 22 may have a rectilinear configuration in which the sidewalls 24 include a vertical front panel 24*a*, opposing rear panel 24*b*, and opposing lateral panels 24*c*. The enclosure defines a vertical axis Va extending through the geometric center of the base plate 21 and horizontal longitudinal axis LA extending perpendicularly to axis Va and centered horizontally between the front and rear panels 24*a*, 24*b* and vertically between top lid 23 and base plate 21. Longitudinal axis LA is oriented parallel to the length dimension of the feed ramp 50 and travel path P1 of the puck P on the ramp.

A first sidewall 24 of the enclosure 22 such as one of the lateral panels 24*c* includes a discharge or ejection port 26 which communicates with the feed ramp to eject and launch a puck from the device. Ejection port 26 is located below horizontal centerline Ch of the enclosure 22 proximate to the bottom base plate 21 to deliver the puck P in a horizontal orientation (i.e. flat sides up and down) in a sliding manner onto the horizontal practice surface H without undue wobbling. An adjoining second panel (disposed at 90 degrees to the lateral panels 24*c*) such as the front panel 24*a* or rear panel 24*b* includes an entrance port 27 which receives pucks dispensed by the puck loader 30 to the feed ramp 50.

Lid 23 may be removably or pivotably mounted to the sidewalls 24. In one embodiment as illustrated, lid 23 may be pivotably mounted to the enclosure 22 by one or more pivot elements 29 disposed on one side of the lid and one of the sidewalls 24 which allows the lid to be opened/closed while remaining attached to the sidewalls. The pivot elements 29 may comprise one or more hinges with pins, a single continuous piano-type hinge, or other forms of hinges or pivotable type attachment elements. The opposite side of the lid 23 from the hinged side may include one or more latches 28 to lock the lid in place. Latches 28 may be any suitable type of closure operable to secure and release the lid 23 from the sidewalls 24. In other implementations, a non-pivotably mounting system may be used and lid 23 may be completely removably via the use of several latches.

Enclosure 22 may include a pair of handles 25, one each disposed on opposite sidewalls 24 such as front and rear panels 24*a*, 24*b* for grasping by a single user to transport the practice device 20. The enclosure 22 may be made of a suitably strong and durable material for transport and use, such as without limitation metallic or polymeric materials. In one embodiment, the enclosure and base plate 21 may be formed of sheet metal (e.g. aluminum, steel, etc.).

Motor 90 may be mounted to the base plate 21 via a motor bracket 91 which elevates the motor and firing wheel 70 above the base so that the wheel may freely spin. Motor 90 may be any suitable type of AC or DC electric motor with sufficient horsepower to rotate the firing wheel at a rotational speed sufficient to achieve the desired linear acceleration of the puck P when engaged by the spinning wheel. In one implementation as shown, firing wheel 70 may be directly coupled to the drive shaft 92 of the motor. This eliminates the inefficiencies associated with maintaining wheel speed and speed fluctuations associated with belt-type drive systems. In one embodiment, motor 90 may be a variable speed type drive comprising a internal speed controller and potentiometer which allows a user to pre-selected and adjust the rotational speed of the firing wheel and hence delivery speed of the puck. In one embodiment, the rotational speed (rpm) of the motor may be sufficient to generate puck speeds of 40 miles per hour (mph) or more.

Referring now to FIGS. 9-17, feed ramp 50 is mounted to and supported by the base 21 of the practice device 20. The feed ramp includes a concave and arcuately curved feed surface 51 arranged to slideably engage a puck P delivered by the puck loader 30. The feed surface may form approximately a 90 degree or less arc in extent. In one non-limiting embodiment, the feed surface arc may be between 75 and 90 degrees.

Feed surface 51 is supported by opposing lateral sides 52 lateral sides of the feed ramp. The bottom edges 53 of the lateral sides 52 may each include one or more outwardly protruding flanges 55 to facilitate attaching the ramp to the base plate 21. The feed ramp 50 may be mounted to the base via fasteners, welding, soldering, adhesives, or other suitable means. The lateral sides 52 protrude generally upwards beyond the feed surface 51 to locate the top edges 54 of the sides above the feed surface forming a U-shape in transverse cross section. This acts to hold the puck P on the ramp as it slides from the top to bottom of the ramp. The feed surface 51 has a width W1 defined by the lateral sides 52 which is slightly or marginally wider than the diameter D1 of the puck P that is sufficient to allow the puck to slide along the ramp yet at the same time prevent excessive lateral movement of puck on the ramp. This ensure that the firing wheel 70 engages and launches the puck in the manner described herein.

Feed surface 51 comprises a top end defining an upper puck receiving portion 51*a*, a bottom end defining a lower puck discharge portion 51*b*, and an intermediate puck engagement portion 51*c* disposed therebetween in which the firing wheel 70 engages and accelerates the puck P. The puck receiving portion 51*a* is located proximate and adjacent to the puck loader 30. The discharge portion 51*b* is distal most from the puck loader. In operation of the device, the puck is deposited on the receiving portion 51*a* by the puck loader 30, slides downwards along on the ramp to the engagement portion 51*c* where it is engaged and accelerated by the firing wheel 70, and then is discharged or ejected from the ramp and practice device 20 in the discharge portion 51*b*. In one embodiment, the puck receiving portion 51*a* of feed surface 51 may be disposed at an oblique angle A1 to the horizontal centerline Ch of the firing wheel 70, which in one non-limiting implementation may be between 0 and 90 degrees (see, e.g. FIG. 9). In other embodiments, the puck receiving portion 51*a* may be arranged perpendicular to centerline Ch (i.e. vertically upright). By contrast, the puck discharge portion 51*b* is horizontally oriented and parallel to centerline Ch. When the practice device 20 is placed on a practice surface, the puck discharge portion 51*b* is preferably located proximate to and preferably spaced above the surface by a short distance (e.g. less than 3 inches).

The firing wheel 70 preferably may be configured and arranged with respect to the feed ramp 50 to create a spatial relationship in which a non-uniform clearance (i.e. distance) or gap G is formed between the circumferential outer surface 76 of the wheel and ramp feed surface 51. To achieve this spatial relationship in one embodiment, the firing wheel is non-concentrically aligned and positioned with respect to the curvature of the feed ramp feed surface 51 in side plan view (see, e.g. FIG. 9). The feed ramp 50 creates a gradually decreasing volute in which the gap G between the ramp feed surface and outside of the firing wheel 70 decreases from the upper receiving portion 51*a* of the ramp to the engagement portion 51*c* (see, e.g. FIG. 9). Accordingly, a maximum first gap G (e.g. distance) is defined between the outer circumferential surface of the firing wheel and the feed surface in the upper puck receiving portion 51*a* of the ramp which decreases to a minimum second gap G' defined between the outer circumferential surface of the firing wheel and the ramp floor plate in the intermediate engagement portion 51*c* of the feed ramp. The second gap G' is preferably less than thickness T1 of the puck P to deform and compress the firing wheel radially inward towards its center when the wheel encounters a sliding puck on the feed surface 51. The closest distance or point between the ramp and wheel is approximately near bottom dead center of the wheel 70 (e.g. between about 5 to 6 o'clock in FIG. 9 where vertical centerline Cv intersects feed surface 51) proximate to the horizontal straight discharge portion 51*b* of the ramp where gap G' is less than the thickness or height of the puck. When the wheel compresses against the flat top surface 100 of the puck, a compressed footprint is produced as the wheel slightly deforms via the angled radial slots 75 as shown. Conversely, the farthest distance or point between the ramp and wheel may be at approximately the 3 o'clock position of the wheel (where horizontal centerline Ch intersects the feed surface) proximate to the substantially vertical puck receiving portion 51*a* of the ramp. As the puck slides downward on the feed ramp toward engagement with the wheel, the gap between the ramp and wheel gradually decreases until that the puck becomes squeezed between the compressible wheel and ramp for optimum puck acceleration and launching.

Figure 18:
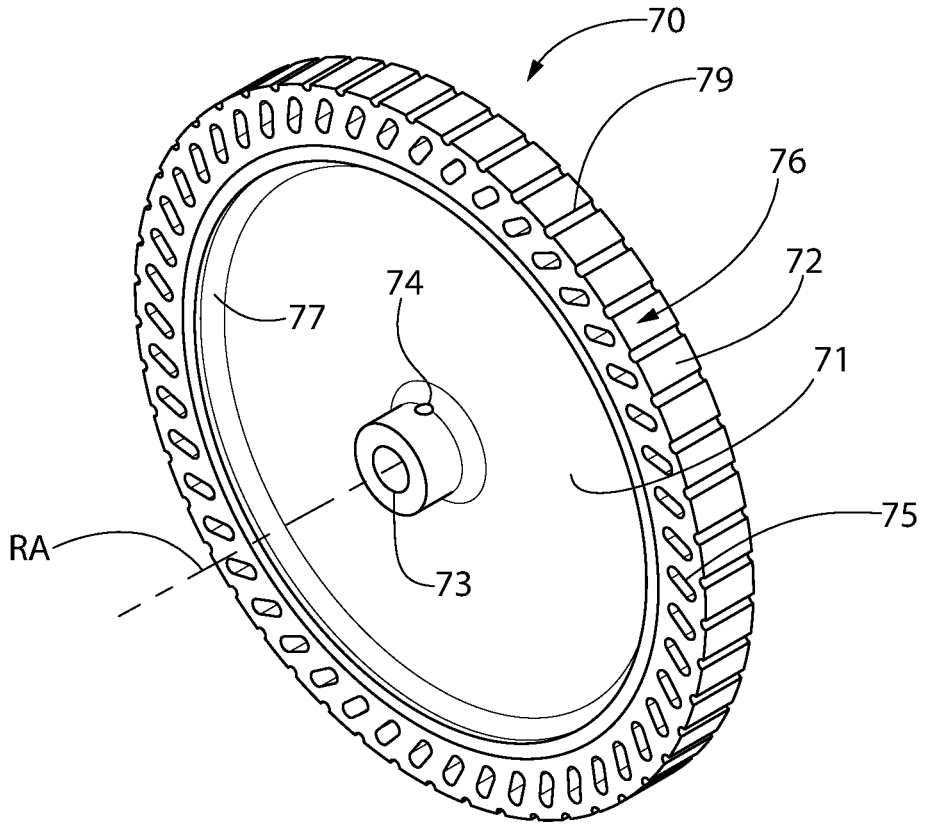
FIGS. 18 and 19 are top and bottom perspective views of the deformably compressible firing wheel of practice device shown in the undeformed condition.
Figure 19:
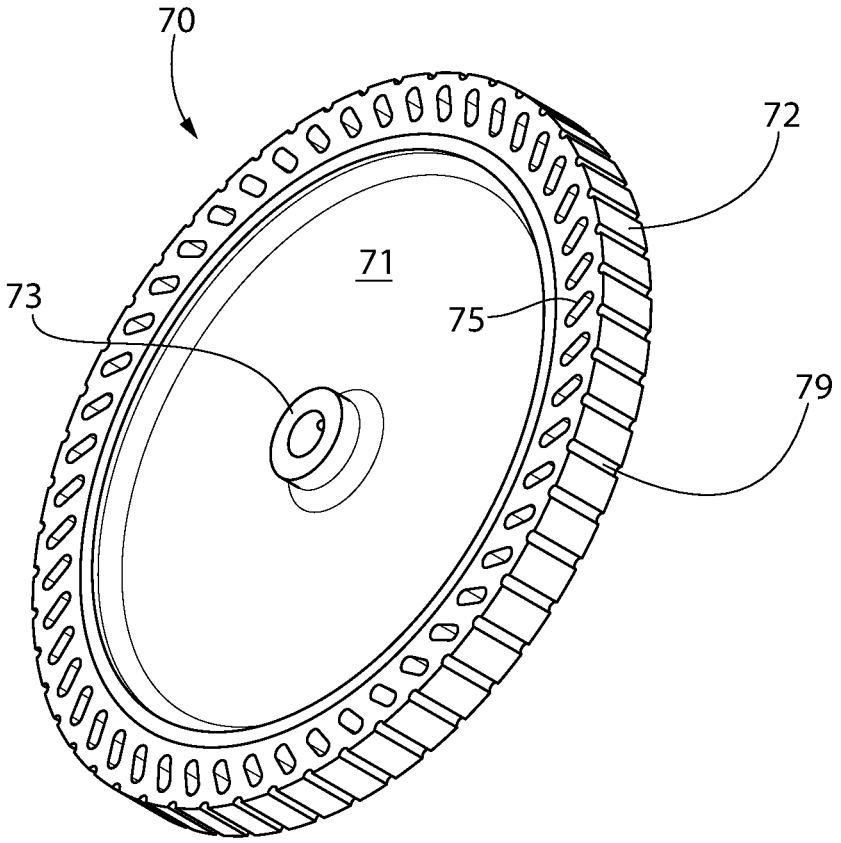
Figure 28:
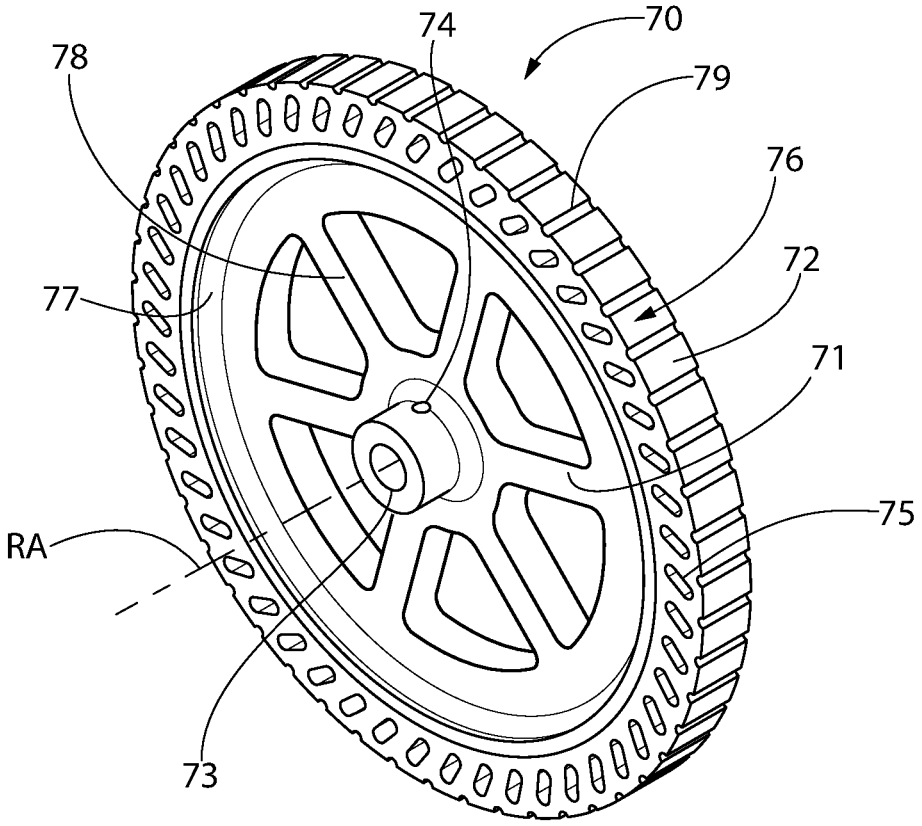
FIG. 28 is a perspective view of an alternative embodiment of a deformably compressible firing wheel of practice device having a spoked hub and shown in the undeformed condition.

Referring particularly now to FIGS. 18-25, the firing wheel 70 may have a composite construction in one embodiment which may comprise a circular central hub 71 configured for coupling to the motor drive shaft 92 and a peripheral annular outer tread ring 72 attached to the inner ring. The hub 71 defines an annular rim 77 to which the tread ring 78 is mounted. The hub 71 may be substantially solid as shown in FIG. 18, or alternatively may comprise a plurality of angularly spaced apart radial spokes 78 as shown in FIG. 28.

The central hub 71 may be secured to the motor drive shaft 92 via a transverse central bore 73 defined by the hub. In one embodiment, the bore 73 may be defined by a cylindrical mounting sleeve or boss 73 in the hub. The central bore 73 defines a rotational axis RA of the firing wheel extending transversely to the hub 71. A coupling element 74 such as a set screw (as shown) or other suitable means may be used to secure the wheel to the motor drive shaft via the boss 73. Hub 71 may be formed of any suitably rigid capable of operating at high rotational speeds (rpm), such as for example without limitation metal (e.g. aluminum, steel, etc.) or suitably rigid and durable plastic materials (e.g. urethane, etc.).

For convenience of reference, firing wheel 70 defines a vertical centerline Cv extending through the geometric center at bore 73 of the wheel and a horizontal centerline Ch extending through the center and arrangement and oriented perpendicular to centerline Cv.

Tread ring 72 may have a thickness T2 less than the diameter of the hub 71. In one preferred implementation, the hub 71 and outer tread ring 72 may each be formed of a non-porous polymeric material such as urethane. Because the pucks are formed of a dense rubber material and the speed of the wheel in the present invention is consideration, porous or spongy wheel materials are less suitable for creating tight non-slip surface contact between the puck and firing wheel 70 which is desirable for accelerating the puck to high speeds. In addition, porous materials are less suitable for enduring the high rotational speeds associated with the present firing wheel without undue deformation from speed alone which advantageously comprises the grip of wheel on the puck.

In one preferred but non-limiting construction, the central hub 71 and tread ring 72 are both formed of urethane but with different hardnesses. Because the hub 71 supports the tread ring 72, the inner hub requires a urethane material having a hardness that can provide greater rigidity to the structure than the tread ring. Conversely, the tread ring 72 has a hardness less than the inner ring 78 thereby making the ring more compressible than the urethane hub to better grip and engage the puck P in a non-slip manner. In one non-limiting example, the tread ring 72 may be formed of a 55-60A durometer urethane material and inner ring 78 may be formed of a higher hardness 75A durometer material. In one exemplary embodiment shown in FIG. 28, the urethane hub 71 comprises a plurality of radial spokes 78. The inventor has discovered that this urethane-on-urethane construction provides a light weight firing wheel 70 structurally capable of withstanding high rotational speeds, yet which can positively grip and accelerate a hard rubber puck to the desired speeds (e.g. about 40 mph or more).

A plurality of elongated and obliquely angled elongated through slots (with respect to a vertical and horizontal wheel axes Wv and Wh passing through the central bore 73 of the hub 71 of the wheel) formed in the outer tread ring 72. Axis Wv is perpendicular to axis Wh. This allows the wheel tread to deform and compress more when engaged with the puck P to maximize the contact footprint of the tread on the puck. This creates a larger surface area of contact resulting in higher friction between the puck and wheel to better grip the puck. The through slots 75 extend transversely and laterally with respect to the firing wheel 70 (i.e. parallel to rotational axis RA) and penetrate each opposing lateral side of the tread element. The angle of the slots 75 preferably is oriented relative to the directional rotation of the wheel in certain embodiments to allow for maximum compression. Accordingly, the leading edge of each slot with respect to the rotational direction of the wheel (e.g. clockwise in FIG. 26A—see directional arrows) is on the inside of tread ring 72 whereas the trailing edge is on the outside. In other implementations, however, it is possible that the feed wheel may be constructed of a single or composite materials without angled through slots.

Figure 20:
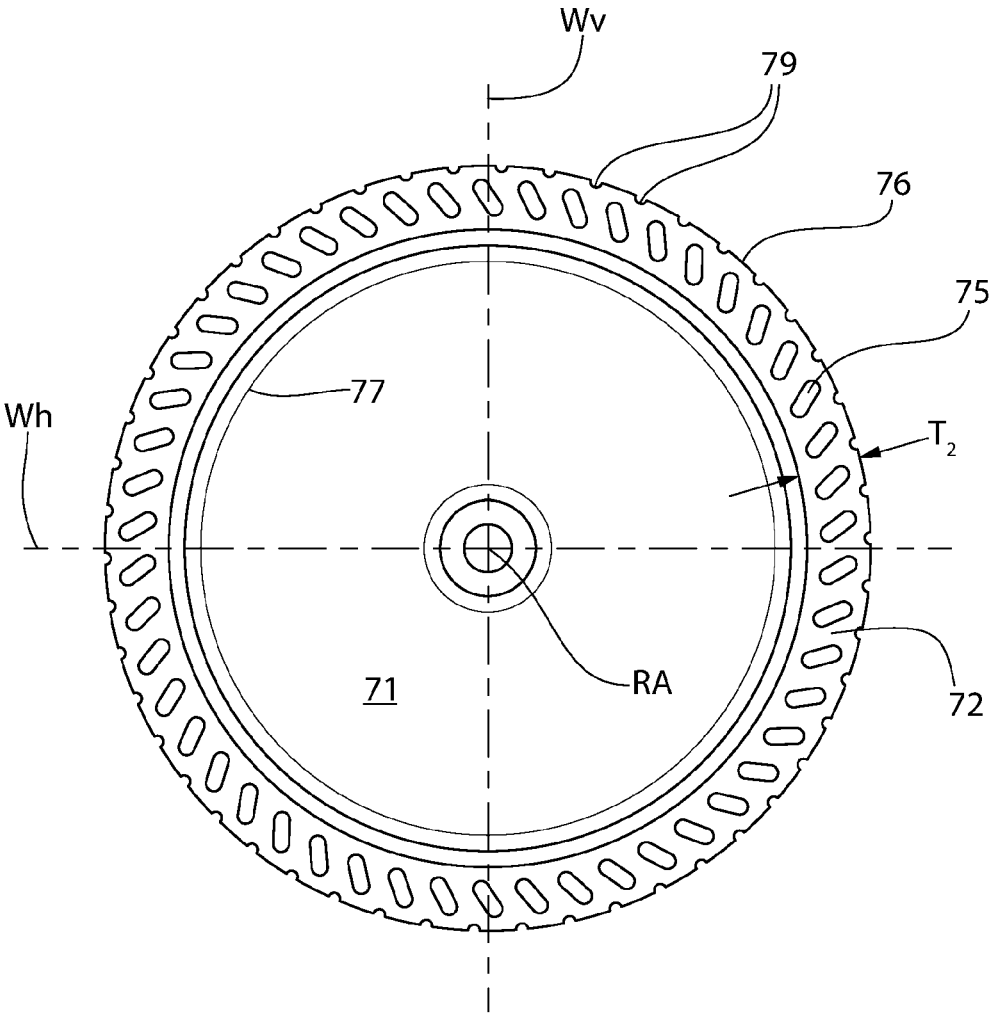
FIG. 20 is a side elevation view thereof.
Figure 22:
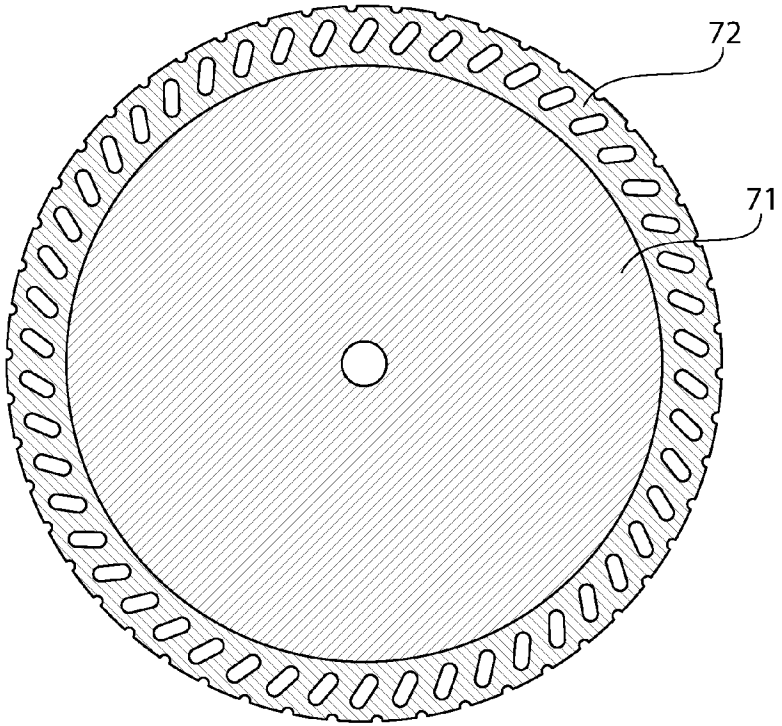
FIG. 22 is a cross sectional view thereof.
Figure 21:
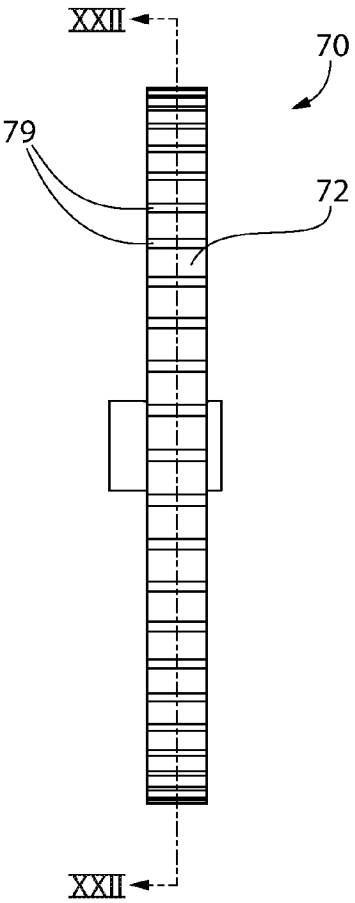
FIG. 21 is an end view thereof.

In one embodiment, transversely oriented sipes or grooves 79 may be formed on the outer circumferential surface 76 of the tread ring 72. Advantageously, the inventor has discovered that this significantly creates a larger coefficient of friction between the firing wheel 70 and the outside of the wheel which significantly increases the grip on the largely incompressible hardened rubber puck for inducing spin and accelerating the puck without slippage. Such considerations are not applicable to other types of non-disk shaped projectiles launched by a rotating wheel. Grooves 79 are circumferentially spaced apart around the circumference of the tread ring 72, preferably at regular equidistant intervals. The grooves are preferably arranged between the through slots 75 as best shown in FIG. 20 to maximize the thickness of material between the slots and grooves, which contributes to better wheel durability and life. In one arrangement, the grooves are oriented parallel to each other and the rotational axis RA of the firing wheel 70. The grooves may be spaced circumferentially apart such that preferably at least two grooves can engage the top surface of the puck. In other possible arrangements contemplated, the grooves may be obliquely angled to the rotational axis RA but may still be parallel to each other or obliquely angles to each other. In the illustrated embodiment, grooves 79 may extend continuously from one lateral side to the other of the firing wheel 70 to maximize grip and friction engagement between the puck and wheel.

When mounted on the motor 90, the firing wheel is vertically oriented and in an upright position with respect to the base plate 21. The wheel rotates in a vertical rotational plane Vp spaced apart from but proximate to the feed ramp 50. The firing wheel 70 and rotational plane Vp defined by the wheel are orientated transversely to the arcuate length of the ramp feed surface 51.

Unlike practice machines which dispense and launch completely round rolling objects such as balls, the design considerations for a disk-like object such as a hockey puck P are markedly different. Rolling object travel across a surface via rolling friction whereas disk-like objects which engage a surface with one of their flat sides travel via sliding friction which typically encounters greater frictional resistance. For clarity, puck P includes opposing top and bottom surfaces 100, 101 and a circumferential side surface 102 extending between the top and bottom surfaces (see, e.g. FIG. 3). In order to deliver the puck in a relatively flat manner onto a horizontal practice surface H when encountering sliding friction, it is desirable to create puck spin when the puck is engaged by the firing wheel 70. This not only replicates the action imparted to the puck by a hockey stick, but maintains the puck on a truer and straighter trajectory or path along the practice surface towards the target after leaving the practice device 20 without undue wobbling.

Figure 17:
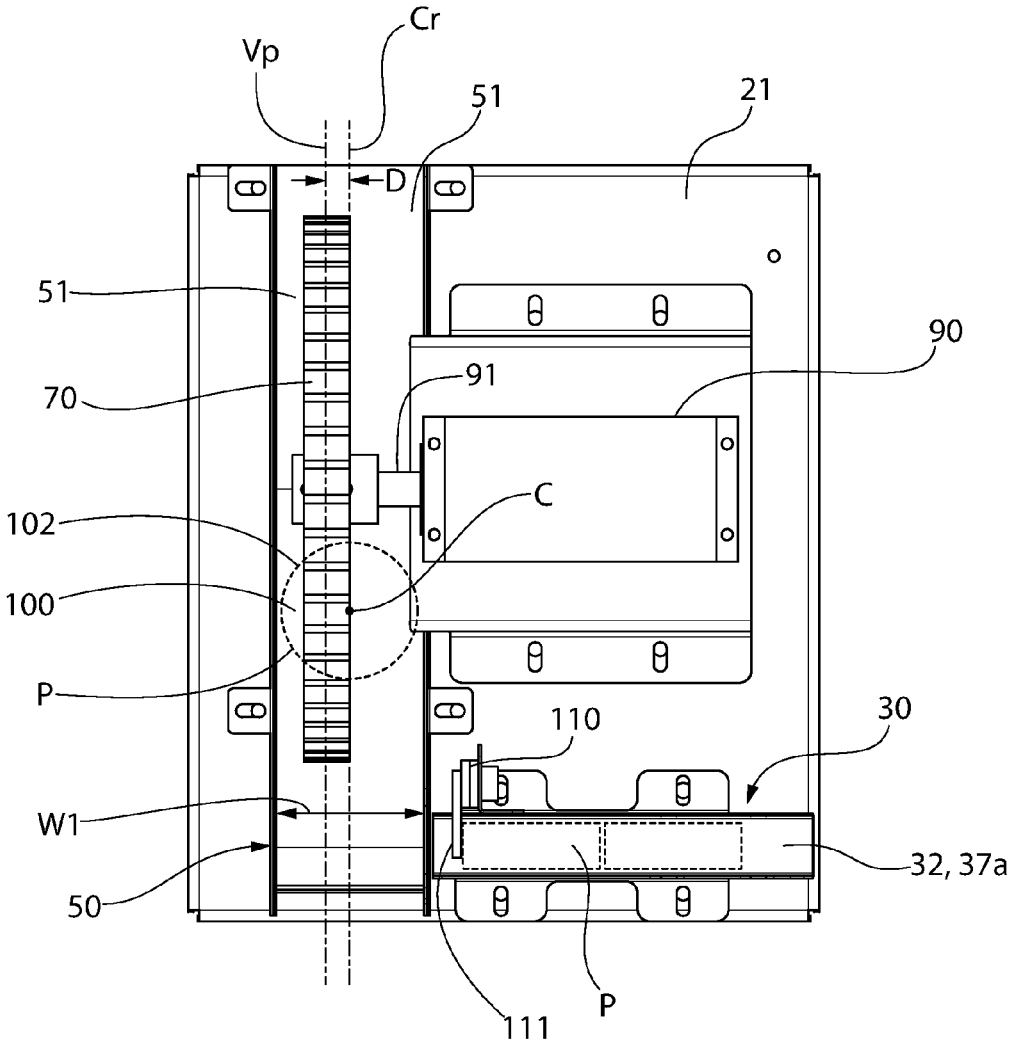
FIG. 17 is a top plan view thereof.

In one embodiment, puck spin or rotation is induced by engaging the firing wheel 70 with the top surface 100 of the puck in an offset manner from the geometric center C (i.e. off center) of the puck which is defined as being midway between diametrically opposed points on the circumference of the puck (see, e.g. FIG. 17). This causes the puck to spin or rotate about its center point when the puck slides along the feed ramp 50 and encounters the firing wheel 70. Accordingly, the firing wheel 70 is arranged so that the vertical rotational plane Vp is laterally offset by a distance D from and arranged off-axis with respect to the centerline Cr of the ramp feed surface 51 as shown in FIG. 17. Centerline Cr is defined equidistant between the sides 52 of the feed ramp 50 that border the feed surface 51. The tread ring 72 therefore preferably has a width less than the width W1 of the feed surface 51 to permit the offset arrangement. In other possible embodiments, however, the firing wheel may be arranged coaxially with centerline Cr of the ramp feed surface 51 to engage the puck at its center C if inducing maximum puck rotation is not desirable.

The inventor has further discovered that a high frictional contact between tread ring 72 on the firing wheel 70 with the puck and low friction contact between the ramp feed surface 51 of feed ramp 50 with the puck advantageously helps to generate and maintain greater spin. The combination of the high friction between the wheel and puck, low friction between the puck and ramp, and off-center engagement of the wheel with the puck, create a mechanism to pass hockey pucks efficiently and maximizes the spin rate induced to the puck launched by the practice device 20.

In one embodiment therefore, the feed surface 51 of feed ramp 50 which engages the bottom surface 101 of the puck P (facing downwards) preferably has a lower friction characteristic (i.e. coefficient of friction) than the firing wheel 70 which engages the top of the puck (facing upwards). In one embodiment, the feed surface 51 of the feed ramp 50 may have a low friction surface coating applied thereto to lower its coefficient of friction. Any suitable low friction coating material may be used such as ceramic coatings, polytetrafluoroethylene (PTFE) coatings such as Teflon™, or others. In yet other embodiments, a low friction feed ramp may be formed with other polymers or highly polished metals applied to or formed as an integral structural part of the feed ramp and feed surface.

Referring to FIGS. 1-17 and 27, puck loader 30 is mounted to base plate 21 via a mounting bracket 34. Bracket 34 may include outwardly protruding flanges 35 from a bottom edge of the bracket to facilitate mounting to the base plate via any suitable means (e.g. fasteners, welding, soldering, adhesives, etc.). Puck loader 30 includes an elongated loading arm 31 configured to hold a plurality of pucks in a vertical position and horizontally stacked end-to-end relationship (i.e. circumferential side to circumferential side). Loading arm 31 is oriented and arranged transversely to arcuately curved feed surface 51 of the feed ramp 50 to transversely dispense pucks P onto the ramp for feeding the firing wheel 70. Loading arm 31 has a width less than the diameter D1 of the puck to maintain the vertical orientation of the pucks. The puck loader dispenses each puck from the loading arm 31 onto the puck receiving portion 51*a* of the feed ramp in a substantially vertical orientation. The loading arm 31 is obliquely angled and inclined with respect to the base plate 21. Advantageously, this allows the pucks P to roll along the length of the loading arm and be dispensed onto the feed ramp 50 via gravity. The bracket 34 is sized to elevate the loading arm 31 a sufficient distance above the base plate 21 to deliver the pucks onto to the puck receiving portion 51*a* of the ramp at its top end. In one embodiment, lower track 32 of the puck loader 30 is located above the center of the firing wheel 70.

In one embodiment the loading arm 31 of puck loader 30 may have a recurvate shape. This maximizes the puck storage capacity while maintaining a compact footprint and configuration of practice device 20 for easy handling and transport. In this configuration, the loading arm includes a lower track 32 that engages the pucks in a rolling manner, an upper track 33 spaced vertically above the lower track, and an arcuately curved elbow track 36 coupling the lower and upper tracks together. Each track includes a flat bottom dispensing surface 40 for engaging the pucks in a rolling manner and a spaced pair of vertical sides 41 extending upwards from the dispensing surface. The tracks 32 and 33 are arranged to maintain the obliquely angled arrangement of the loading arm 31 wherein track 32 is also obliquely arranged with respect to the track 33 (and vice-versa) and the base plate 21. The stack of pucks P roll from the upper track onto the lower track through the elbow track via gravity. It bears noting for contrast that the pucks travel by rolling action through the puck loader 30 whereas the pucks travel via sliding action along the feed ramp 50.

To enhance portability of the practice device 20, the puck loader 30 may be at least partially disassembled and reassembled without the use of tools or fasteners. To achieve this, the puck loader 30 comprises a system of interlocking pairs of laterally spaced apart slots 38 and pins 39. The lower track 32 includes a fixed section 37*a* fixedly attached to the mounting bracket 34 and a detachable section 37*b* which may be removably coupled to the fixed section. Fixed section 37*a* may be fully mounted inside enclosure 22 adjacent to entrance port 27 or may protrude slightly outwards beyond the port. Fixed section 37*a* may include at least two, and preferably four slots 38 in one non-limiting arrangement which receive and engage laterally protruding pins 39 extending outwards from detachable section 37*b*. Slots 38 may each be generally L-shaped having each have an upwardly open end and a closed end forming The pins 39 are inserted downward into their respective slots 38 through the open ends and then slid to the closed end of the slots to secure the detachable section 37*b* to the fixed section 39*a*. In one embodiment, the detachable section 37*b* of the lower track 32 may be fixedly attached to the elbow track 36 forming part of the elbow assembly.

The upper track 33 includes at least one pair of pins 39 which engage a mating pair of slots 38 disposed on a stub section 36*a* of the elbow track 36. The upper track 33 is mounted in a similar manner as described above for the detachable section 37*b* of the lower track. In operation, pucks P travel and roll along the upper track 33 in a direction away from the feed ramp 50, move through the elbow track 36 to reverse direction, and then continue to roll along lower track 32 in a direction towards and onto the feed ramp 50.

To regulate the feed of pucks P from the puck loader 30 to the feed ramp 50 in a sequentially timed manner, a servomotor 110 which operates a openable/closeable arm 111 is provided with the puck loader 30. The arm of the servomotor acts as a "gate." Pucks are held on the puck loader by the servomotor arm, and puck feed is controlled by the servomotor when released by the arm. The servomotor 110 may be mounted to the puck loader 30 or directly to the base via a suitably configured mounting bracket 42. The bracket is located to position the servomotor arm across the terminal end of the lower track 32 of the loading arm 31 directly adjacent to the feed ramp 50 as illustrated.

In some embodiments, the servomotor operation and position of the gate arm 111 are automatically controlled by an electronic controller 112 comprising appropriately configured circuitry and processor components. The same controller may also be used to also control the wheel motor 90. Accordingly, one controller provided with appropriate user interface switches, buttons, display indicators, etc. comprising a control panel 113 mounted on the front panel 24*a* of the enclosure 22 may be used to control both the puck loader servomotor 110 and the main feed motor. The controller 112 may be mounted to the front panel 24 of the enclosure and electrically wired to the servomotor 110. In other implementations, it will be appreciated that controllers may be provided.

In certain implementations, the dispensing of pucks from the puck loader 30 may be controlled via a wireless or wire-operated control interface device which communicates via control signals with the controller circuitry which is electrically coupled to the servomotor 110. In some implementations, the servomotor may be omitted and dispensing of the pucks from the loader may be controlled by a manually operated gate arm via a second user. The controller may include an adjustable timer circuit which includes a potentiometer to automatically dispense pucks via the servomotor arm 111 at a user-adjustable and pre-selected interval of time. The controller 112 may further include a potentiometer which controls the speed of the wheel motor 90.

In one embodiment, the control panel 113 includes buttons or switches to readily adjust the firing rate (i.e. interval of time between) pucks discharged by the practice device 20 and the speed of the puck. LED displays may be provided to indicate the speed and firing rate of pucks selected by the user.

Operation of the practice device 20 will now be briefly described with reference to the drawings, and particularly FIGS. 26A-D which show sequential steps in the storage, feed, and discharge of the pucks from the device. The device 20 is first placed on the horizontal practice surface H in the desired location. If not already assembled, the puck loader tracks 32 (i.e. detachable section 37*b*), 33, and 36 may be assembled via the slot and pin system previously described herein.

Figure 26A:
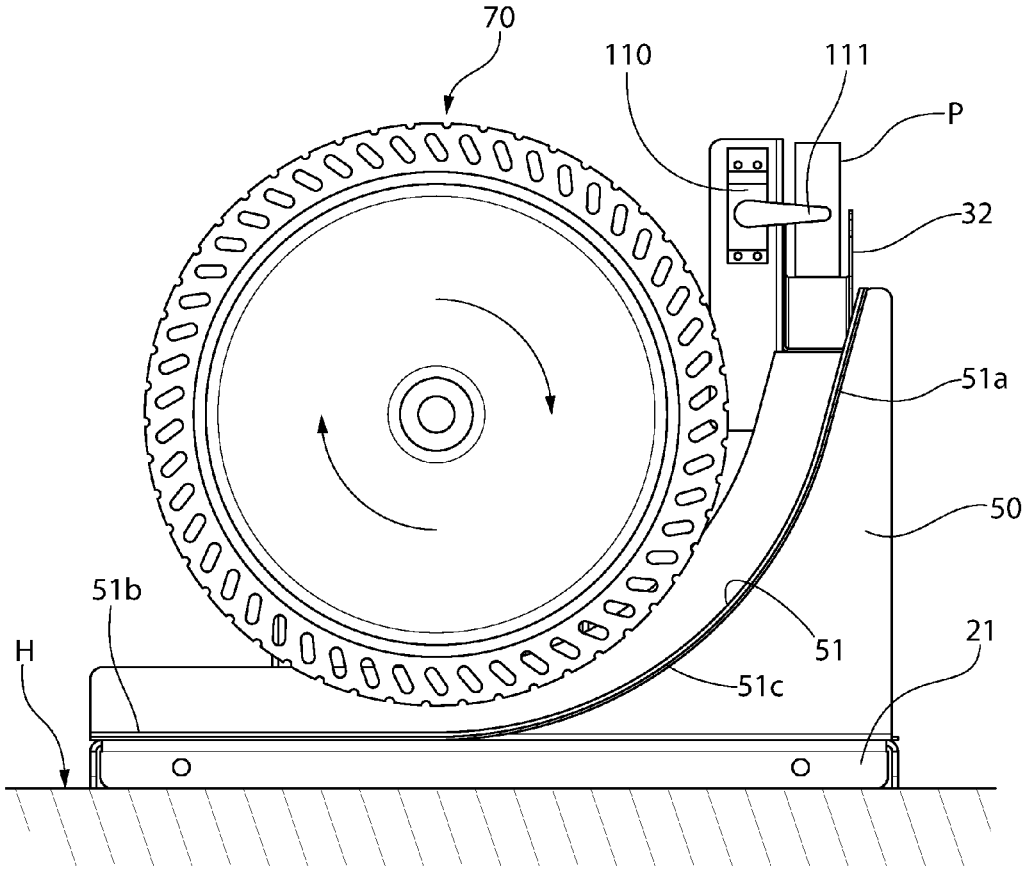
FIGS. 26A-D show sequential steps in firing a puck at a target using the foregoing practice device.
Figure 26B:
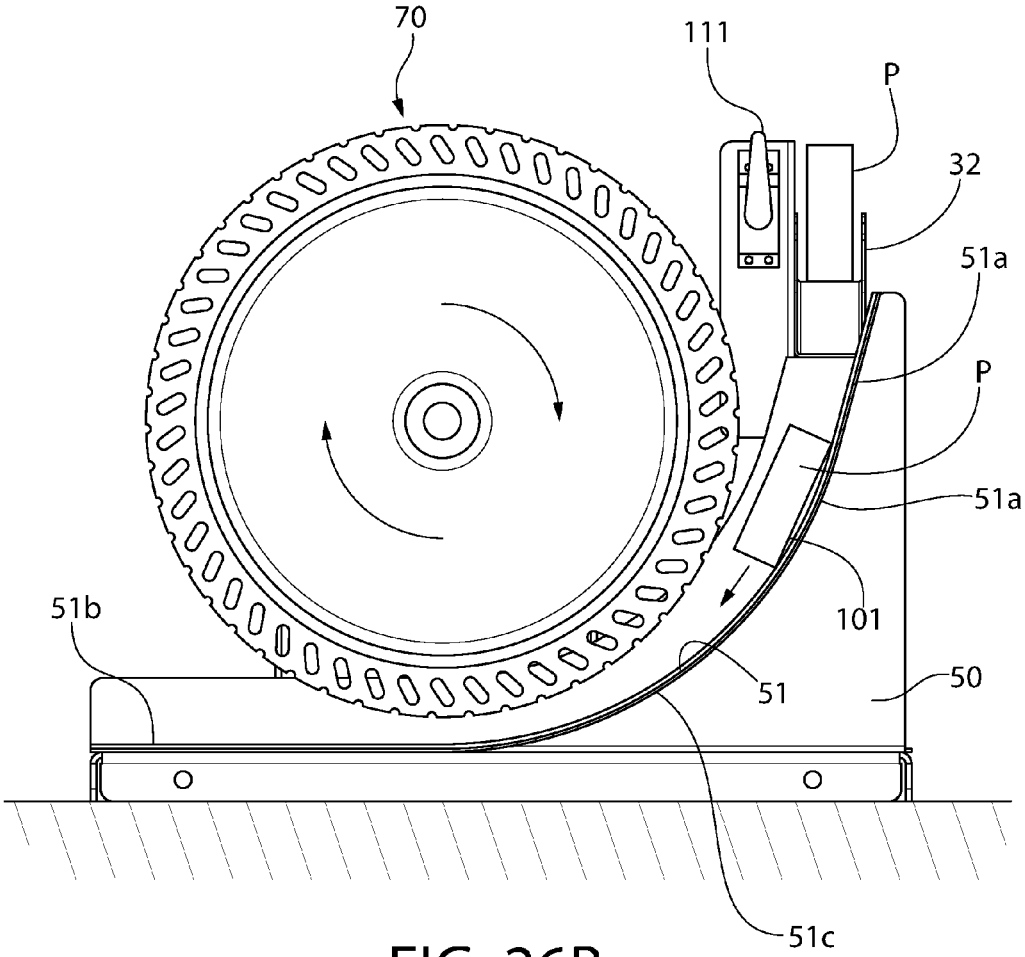

In use, a user may next load one or more pucks onto the inclined loading arm 31 of the puck loader 30. Pucks are positioned on the puck loader with the circumferential outer surface in rolling contact with the substantially flat dispensing surface 40 of the upper and lower tracks 32, 33 of the loading arm 31. Gravity forces the horizontal stack of pucks to roll towards the puck feed ramp and wheel. Pucks are held in place on the puck loader by the servomotor arm 111 until released by servomotor 110 via a control signal received from the controller 112. In the closed position, the servomotor arm 111 is substantially horizontal. FIG. 26A shows the loaded puck loader 30 with the arm 111 in the closed position engaging the leading puck. The firing wheel 70 is in the undeformed condition. The wheel motor 90 may now be started by the user if not already activated to rotate the firing wheel 70 at a user pre-selected speed via control panel 112 as described above. The time interval between puck released from the puck loader 30 (i.e. firing rate) via operation of servomotor gate 111 may also be pre-selected using the control panel.

When the servomotor arm 111 is lifted upwards to a vertical open position (FIG. 26B), the leading puck engaged by the arm is released, rolls towards, and is deposited onto the upper puck receiving portion 51*a* of the arcuately curved feed ramp feed surface 51 by the puck loader. The puck is dispensed in an upright position, which may be vertically or substantially vertically (accounting for slight angular shift of the puck in orientation when the puck free falls a preferably short distance before contacting the ramp feed surface). In this position, the top surface 100 of the puck is facing inwards towards the firing wheel 70. The pucks are positioned on the lower track 32 of the puck loader 30 above the center of the firing wheel and may make initial contact with the ramp feed surface 51 slightly above the center as well in some embodiments.

The puck loader 30 is configured and operable to deposit a single puck at a time onto the feed ramp 50 in the foregoing non-horizontal position. Immediately after one puck passes by the servomotor arm 111, the arm automatically returns to the closed position to engage and hold the next of the remaining pucks on the puck loader.

Figure 26C:
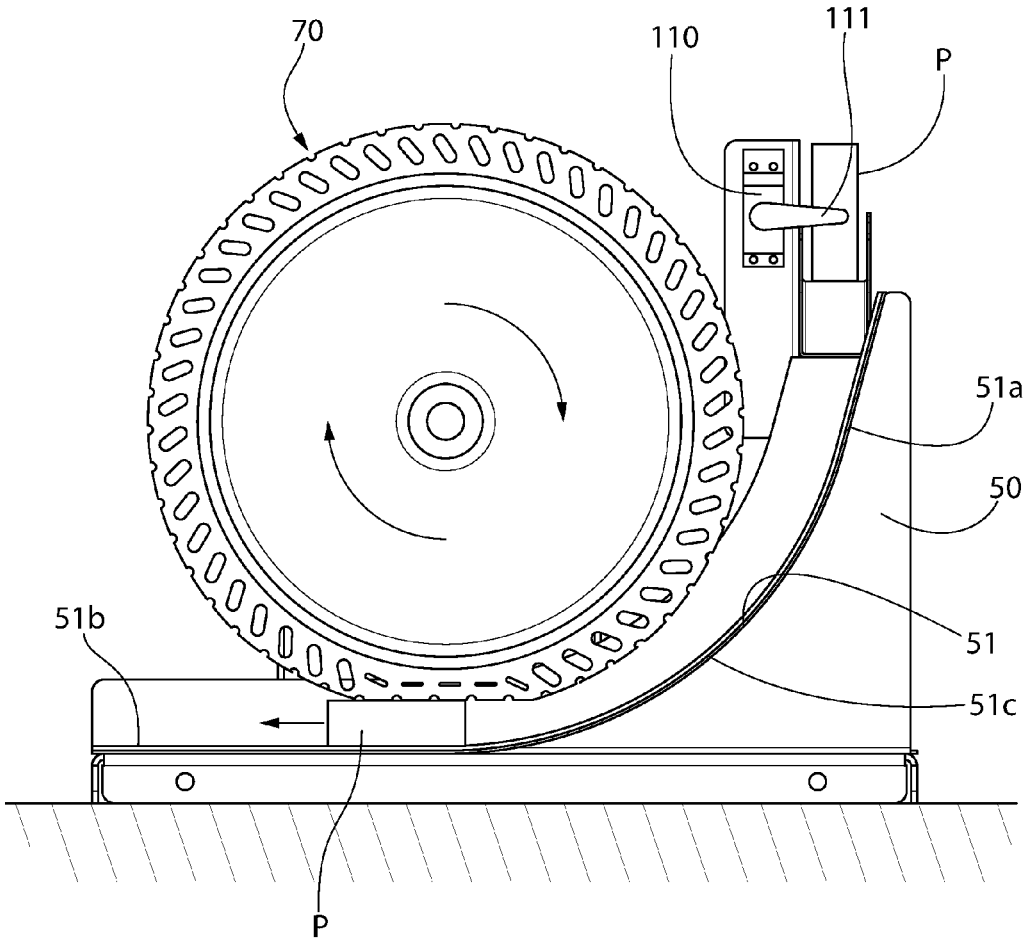

The puck P slides down the feed surface 51 onto the engagement portion 51*c* of the ramp and directly beneath the firing wheel 70 from the force of gravity. This is shown in FIG. 26C. The pucks slide down the ramp with the flat bottom surface 101 of the puck engaging the ramp feed surface 51. The puck engagement portion 51*c* of the feed ramp 50 is arcuately curved and radiused which operates to change orientation of the puck P from the vertically upright position to a horizontal position as the puck travels beneath and past the firing wheel 70. The top surface 100 of the puck then faces in an upward direction parallel to the horizontal centerline Ch of the firing wheel (perpendicular to vertical axis Cv) instead of in a forward direction perpendicular to centerline Ch (parallel to vertical axis Cv).

As noted above, the feed surface 51 of the ramp may be topped or coated with a layer of Teflon™ or similar low friction material to create a low friction surface for the pucks to slide on. The puck firing wheel 70 by contrast is constructed and configured to produce high frictional contact with the puck. This allows the wheel to firmly engage and accelerate the puck towards the lower substantially horizontal end portion of the ramp for launching towards a target across the horizontal practice surface H such as ice or other playing surface.

Figure 23:
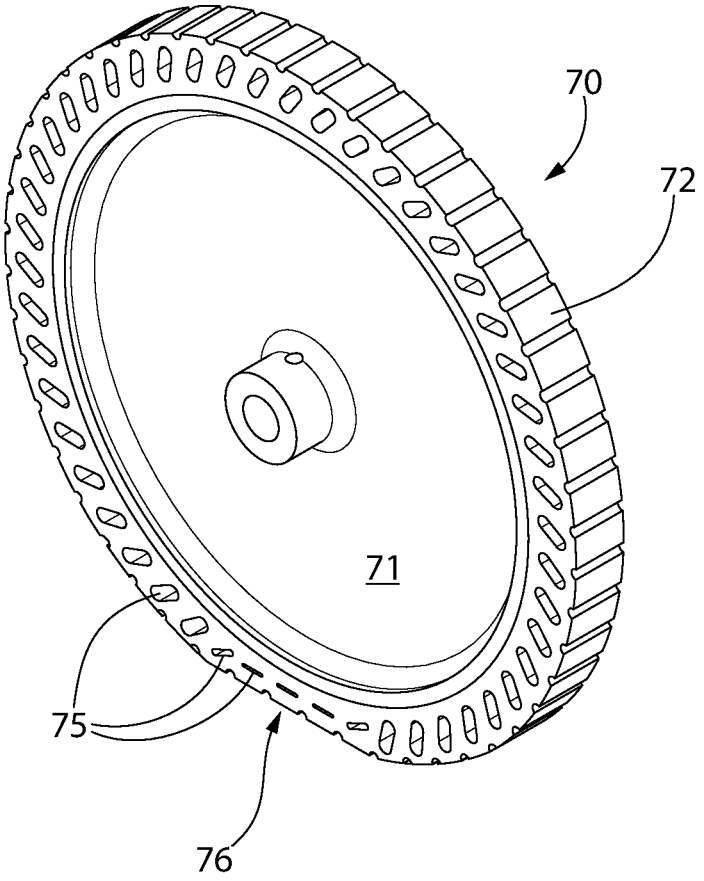
FIGS. 23 and 24 are top and bottom perspective views of the firing wheel of practice device shown in the deformed compressed condition.
Figure 24:
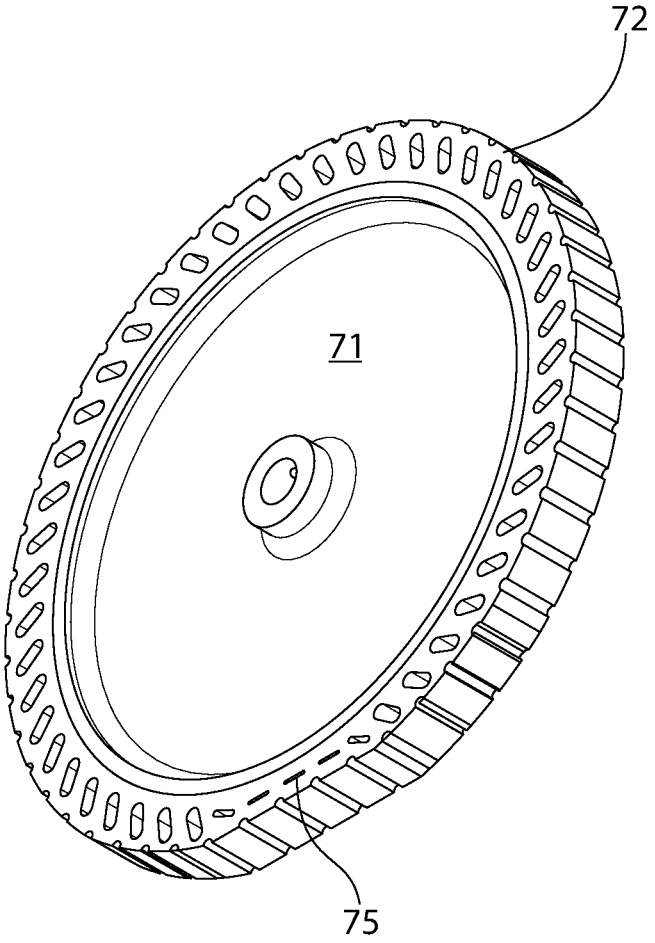
Figure 25:
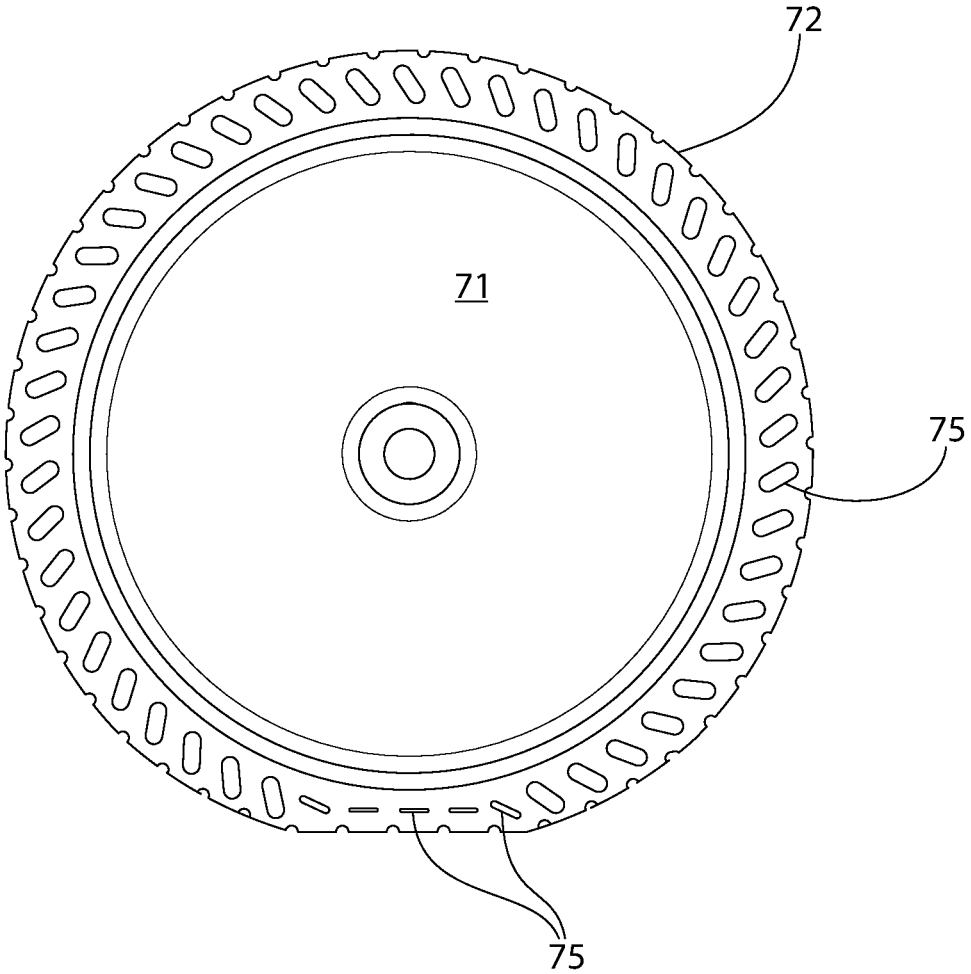
FIG. 25 is a side elevation view thereof.

As the wheel 70 rotates via operation of the main drive motor 90, the outer tread ring 72 of the wheel engages and grips the top surface 100 of the puck on the ramp in the offset manner fully described above. Because the gap G between the wheel 70 and puck is smaller than the thickness T1 of the puck, this compresses the tread ring 72 of the wheel thereby deforming the angled through slots to increase contact surface area between the wheel and puck (see, e.g. FIG. 26C). FIGS. 23-25 show the deformed condition of the firing wheel 70. This high frictional and offset engagement between the wheel and puck causes the puck to rotate and spin about its center as it continues to travel under the wheel and through the engagement portion 51*c* of the ramp.

Figure 26D:
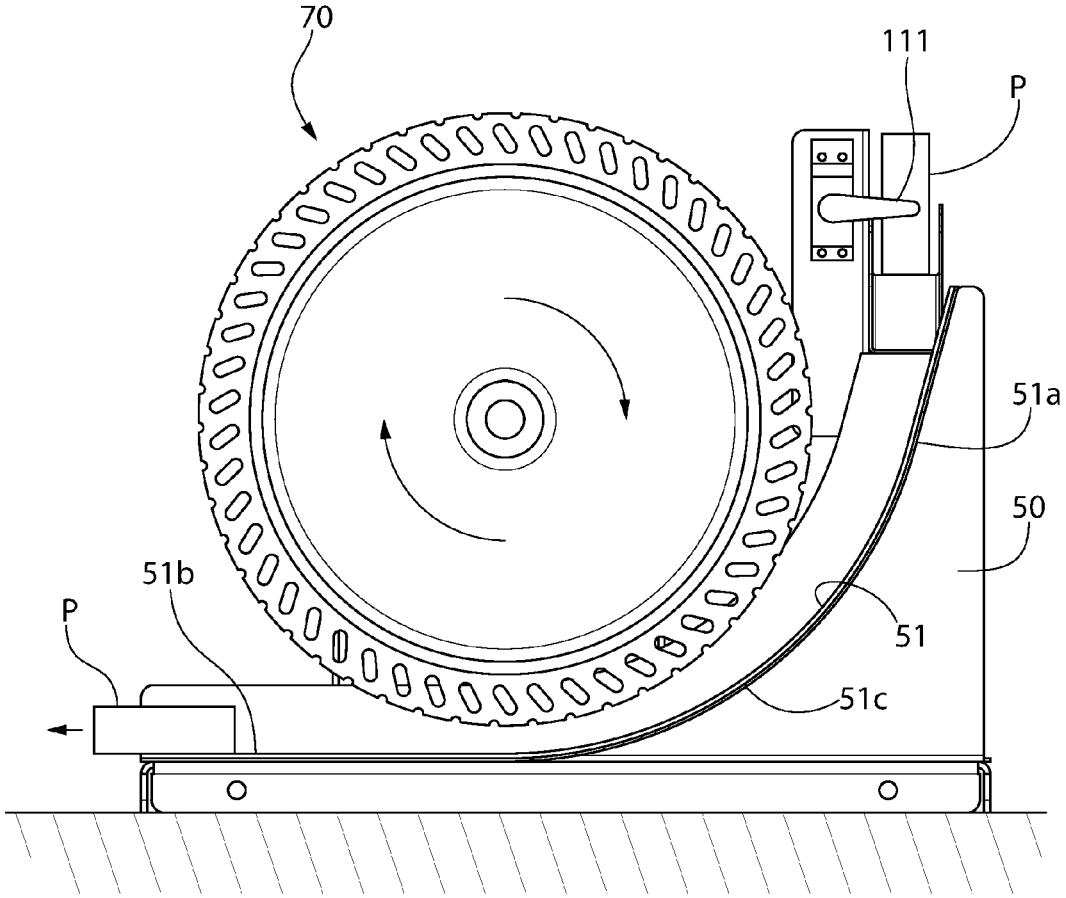
Figure 27:
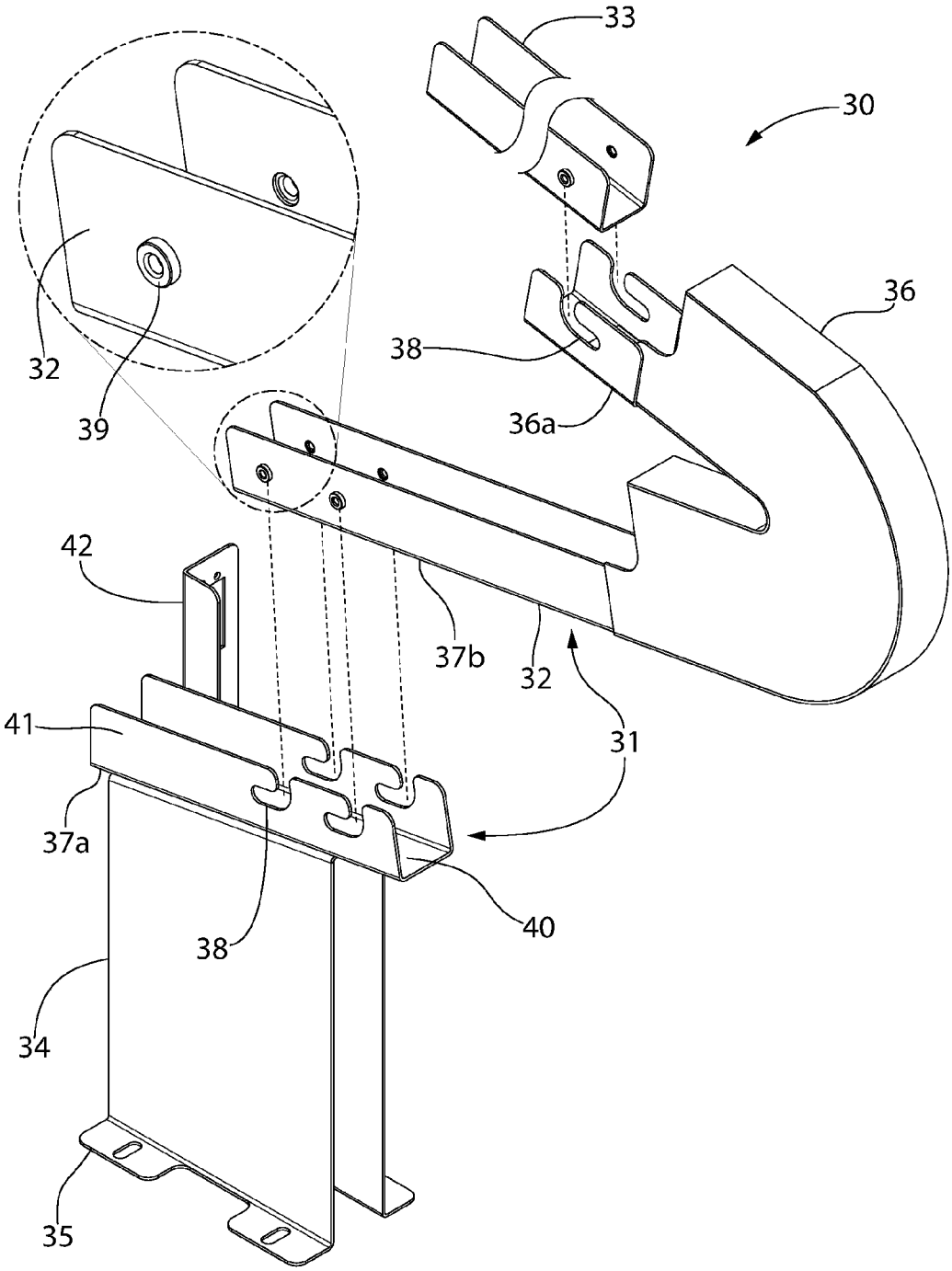
FIG. 27 is an exploded perspective view of the puck loader of the practice device.

The puck now accelerated by the firing wheel 70 breaks contact with the wheel and travels a short distance on the discharge portion 51*b* of the ramp feed surface 51. In one embodiment, the discharge portion 51*b* has a length extending for a horizontal distance beyond the outer surface of the firing wheel sufficient to dynamically stabilize the puck (re-oriented from vertical to horizontal position through the puck engagement portion 51*c* of the ramp feed surface) and its trajectory path after engagement by the wheel FIG. 26D shows the puck being discharged or ejected from the feed ramp 50 as it is launched out of the ejection port 26 formed in the front panel 24*a* of the practice device 20 and onto the practice surface H towards the target. The puck continues to slide across the practice surface while rotating/spinning to advantageously replicate an actual pass from a hockey stick, thereby providing an optimum practice experience. The puck advantageously further travels across the practice surface in a substantially true linear path attributable to the spin action of the puck.

The foregoing process is repeated until all of the pucks loaded on the inclined puck loader are released by the servomotor 110, fed onto the feed ramp 50, and discharged by the firing wheel 70. The pucks may then be reloaded onto the puck loader 30 by simply placing the pucks one at a time onto the upper track 33 with the curved sides 102 of the puck engaging the track. Gravity causes the loaded pucks to roll along the upper track, through the elbow track 36, and onto the lower track 32 until the leading puck (first one loaded) engages the servomotor gate 111 as described herein. Another practice session is ready to begin.

Following completion of the practice session, the puck loader 30 may be partially dismantled as described previously herein via the slot and pin system for transport.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A hockey practice device for launching hockey pucks towards a target, the hockey practice device comprising:

a planar base for resting on a horizontal surface;

a motor supported by the base;

a compressible firing wheel coupled to the motor and rotatable in a vertical rotational plane via operation of the motor;

a feed ramp mounted proximate to the firing wheel and including an arcuately curved feed surface arranged to slideably engage a puck;

a puck loader having an elongated loading arm configured to hold a plurality of the pucks and arranged to dispense the puck onto the feed ramp;

wherein the vertical rotational plane of the firing wheel is arranged laterally off-axis from a centerline of the feed surface of the feed ramp to engage the puck off center and induce spin to the puck;

wherein a peripheral edge portion of the firing wheel comprises a plurality of deformable angled radial through slots arranged around a circumference of the firing wheel and extending laterally through the firing wheel, each radial through slot oriented at an oblique angle to a vertical centerline of the wheel.

2. The hockey practice device according to claim 1, wherein the feed surface comprises an upper puck receiving portion, a lower puck discharge portion, and an intermediate puck engagement portion disposed therebetween in which the firing wheel engages the puck.

3. The hockey practice device according to claim 1, wherein the feed ramp is configured to form a gradually decreasing volute comprising a gap defined between the feed surface of the feed ramp and an outer circumferential surface of the firing wheel.

4. The hockey practice device according to claim 3, wherein the volute defines a maximum first gap between the outer circumferential surface of the firing wheel and the feed surface in the puck receiving portion of the feed ramp, and a minimum second gap between the outer circumferential surface of the firing wheel and the ramp floor plate in the engagement portion of the feed ramp.

5. The hockey practice device according to claim 4, wherein the second gap is less than a thickness of the puck.

6. The hockey practice device according to claim 1, wherein the vertical rotational plane of the firing wheel is arranged transversely to the feed surface of the feed ramp.

7. The hockey practice device according to claim 1, wherein the feed surface of the feed ramp includes a low friction surface coating.

8. The hockey practice device according to claim 1, wherein the compressible firing wheel is non-concentrically aligned and positioned with respect to the curvature of the feed surface of the feed ramp in side plan view to create a spatial relationship in which a non-uniform gap is formed between the circumferential outer surface of the wheel and the ramp feed surface.

9. A hockey practice device for launching hockey pucks towards a target, the hockey practice device comprising:

a planar base for resting on a horizontal surface;

a motor supported by the base;

a compressible firing wheel coupled to the motor and rotatable in a vertical rotational plane via operation of the motor;

a feed ramp mounted proximate to the firing wheel and including an arcuately curved feed surface arranged to slideably engage a puck;

a puck loader having an elongated loading arm configured to hold a plurality of the pucks and arranged to dispense the puck onto the feed ramp;

wherein the vertical rotational plane of the firing wheel is arranged laterally off-axis from a centerline of the feed surface of the feed ramp to engage the puck off center and induce spin to the puck;

wherein the firing wheel comprises an inner central hub coupled to the motor and an outer tread ring formed of a urethane material which defines a plurality of angled radial through slots extending transversely through the firing wheel.

10. The hockey practice device according to claim 9, wherein the central hub comprises a plurality of radial spokes supporting the outer tread ring, the spokes formed of a urethane material having a greater durometer hardness than the urethane material of the outer tread ring.

11. The hockey practice device according to claim 9, wherein the outer tread ring comprises a plurality of circumferentially spaced apart and outwardly open transverse grooves arranged on an outer circumferential surface of the firing wheel which grippingly engage the puck.

* * * * *